US011359326B2

(12) United States Patent
Damtew et al.

(10) Patent No.: US 11,359,326 B2
(45) Date of Patent: Jun. 14, 2022

(54) ADDITIVE DISPENSER FOR VARYING THE TYPES OF ADDITIVES WITHIN A WASHING MACHINE APPLIANCE

(71) Applicant: Haier US Appliance Solutions, Inc., Wilmington, DE (US)

(72) Inventors: Fikreadam Abebe Damtew, Louisville, KY (US); Troy Marshall Wright, Louisville, KY (US); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 162 days.

(21) Appl. No.: 16/789,545

(22) Filed: Feb. 13, 2020

(65) Prior Publication Data

US 2021/0254260 A1 Aug. 19, 2021

(51) Int. Cl.
*D06F 39/02* (2006.01)
*D06F 39/08* (2006.01)

(52) U.S. Cl.
CPC ..... *D06F 39/028* (2013.01); *D06F 39/022* (2013.01); *D06F 39/088* (2013.01)

(58) Field of Classification Search
None
See application file for complete search history.

(56) References Cited

U.S. PATENT DOCUMENTS

| | | | |
|---|---|---|---|
| 5,836,180 | A | 11/1998 | Herman-Latack et al. |
| 8,206,512 | B2 | 6/2012 | Banta et al. |
| 9,644,308 | B2 | 5/2017 | Leibman et al. |
| 10,422,068 | B2 | 9/2019 | Ihne et al. |
| 2017/0350060 | A1 | 12/2017 | Favaro et al. |
| 2018/0355543 | A1 | 12/2018 | Cinello |

FOREIGN PATENT DOCUMENTS

| | | | | |
|---|---|---|---|---|
| CN | 201546074 | U | 8/2010 | |
| EP | 0850590 | A1 | 7/1998 | |
| EP | 3037582 | A1 | 6/2016 | |
| EP | 3293302 | A1 * | 3/2018 | ..... D06F 39/02 |
| EP | 3293302 | A1 | 3/2018 | |
| JP | 2016073330 | A | 5/2016 | |
| JP | 2018000856 | A | 1/2018 | |
| WO | WO2016102005 | A1 | 6/2016 | |
| WO | WO2018050537 | A1 | 3/2018 | |

OTHER PUBLICATIONS

Espacenet translation JP2016073330A Washing Machine, Masuda (Year: 2016).*

* cited by examiner

*Primary Examiner* — Cristi J Tate-Sims
(74) *Attorney, Agent, or Firm* — Dority & Manning, P.A.

(57) ABSTRACT

A washing machine appliance, as provided herein, may include a cabinet, a tub, a basket, and a fluid additive dispenser. The fluid additive dispenser may include a housing and a dispenser drawer. The housing may extend between an open front end and a closed rear end. The housing may be disposed within the cabinet. The dispenser drawer may be selectively received in the housing above the basket. The dispenser drawer may extend from a forward end proximate to the rotation axis to a rearward end distal to the rotation axis. The dispenser drawer may define a primary compartment and a pod compartment adjacent to the primary compartment between the forward end and the rearward end. The dispenser drawer may further define a pod outlet extending through a wall of the pod compartment to direct a wash fluid therefrom.

19 Claims, 14 Drawing Sheets

ADDITIVE DISPENSER FOR VARYING THE TYPES OF ADDITIVES WITHIN A WASHING MACHINE APPLIANCE

FIELD OF THE INVENTION

The present subject matter relates generally to automated washing appliances, such as washing machine appliances, and more particularly to an additive dispensing assembly for supplying a wash fluid to a washing appliance.

BACKGROUND OF THE INVENTION

Modern washing appliances, such as washing machine appliances and dishwasher appliances, often include an additive dispenser to dispense a wash fluid therefrom. Prior to use of a washing appliance, a wash additive, such as detergent, may be placed within the additive dispenser (e.g., by a user) to be selectively added to a wash chamber during a wash cycle of the appliance. For example, washing machine appliances generally include a tub for containing water or wash fluid (e.g., water and detergent, bleach, or other wash additives), as well as a basket that is rotatably mounted within the tub and defines a wash chamber for receipt of articles for washing. During normal operation of such washing machine appliances, the wash liquid is directed into the tub and onto articles within the wash chamber.

Increasingly, there is a desire by consumers to use discrete additive pods with washing appliances. The additive pods are often filled with a premeasured volume of one or more wash additives (e.g., detergents, fabric softeners, rinse aids, etc.). For instance, a granular wash additive and liquid wash additive may both be encased within a water-soluble casing to form a discrete additive pod. Since they are generally self-contained and eliminate the need for measuring exact amounts of wash additives, additive pods may make using a washing appliance easier. Moreover, use of an additive pod may ensure that the correct amount of wash additive is used for a given wash load.

In spite of these advantages, using additive pods can also present certain drawbacks. For example, in some systems, it may be difficult to ensure that the additive pod dissolves completely. This may be especially true during a cold-water wash cycle. Oftentimes, users are forced to deposit additive pods directly into the wash basket. If the additive pod does not dissolve completely, remnants of the additive pod (e.g., the casing) may accumulate within, for example, the basket. This risks damaging or staining articles within the appliance. Moreover, an undissolved pod is generally wasteful since it can result in some volume of the wash additive not being used for an intended wash cycle. These drawbacks can be magnified if a user tries to use more than one pod or type of pod within the appliance.

As a result, there is a need for improved additive dispensers. In particular, it would be advantageous to provide an additive dispenser that could accommodate multiple different number or types of additive pods. Additionally or alternatively, it would be advantageous to provide an additive dispenser that can ensure improved dissolution of an additive pod during a washing operation.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet, a tub, a basket, and a fluid additive dispenser. The cabinet may define an opening. The basket may be rotatably mounted within the tub to rotate about a rotation axis. The fluid additive dispenser may include a housing and a dispenser drawer. The housing may extend between an open front end and a closed rear end. The housing may be disposed within the cabinet. The dispenser drawer may be selectively received in the housing above the basket. The dispenser drawer may extend from a forward end proximate to the rotation axis to a rearward end distal to the rotation axis. The dispenser drawer may define a primary compartment and a pod compartment adjacent to the primary compartment between the forward end and the rearward end. The dispenser drawer may further define a pod outlet extending through a wall of the pod compartment to direct a wash fluid therefrom.

In another exemplary aspect of the present disclosure, a washing machine appliance is provided. The washing machine appliance may include a cabinet, a tub, a basket, and a fluid additive dispenser. The cabinet may define an opening. The basket may be rotatably mounted within the tub to rotate about a rotation axis. The fluid additive dispenser may include a housing and a dispenser drawer. The housing may extend between an open front end and a closed rear end. The housing may be disposed within the cabinet. The dispenser drawer may be selectively received in the housing above the basket and extend from a forward end proximate to the rotation axis to a rearward end distal to the rotation axis. The dispenser drawer may define a primary compartment and a pod compartment adjacent to the primary compartment between the forward end and the rearward end. The dispenser drawer may further define a pod outlet extending through a wall of the pod compartment. The dispenser drawer may comprise an internal pod wall defining the pod compartment. The internal pod wall may have a tall wall segment and a short wall segment. The tall wall segment may extend circumferentially about a first portion of the pod compartment. The short wall segment may extend circumferentially about a second portion of the pod compartment. The short wall segment may be disposed between the primary compartment and the pod compartment.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
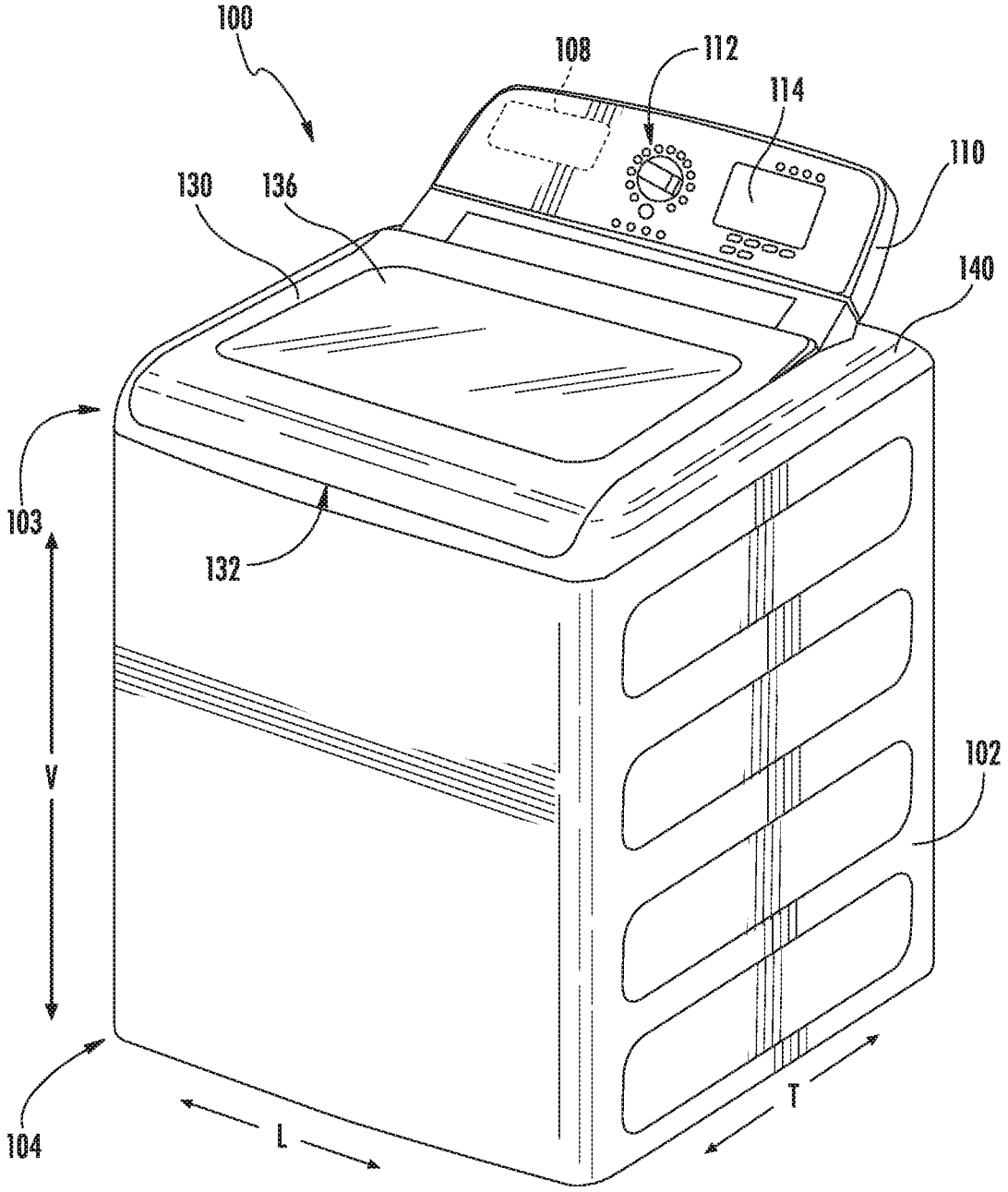
FIG. 1 provides a perspective view of a washing machine appliance according to exemplary embodiments of the present disclosure with a door of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
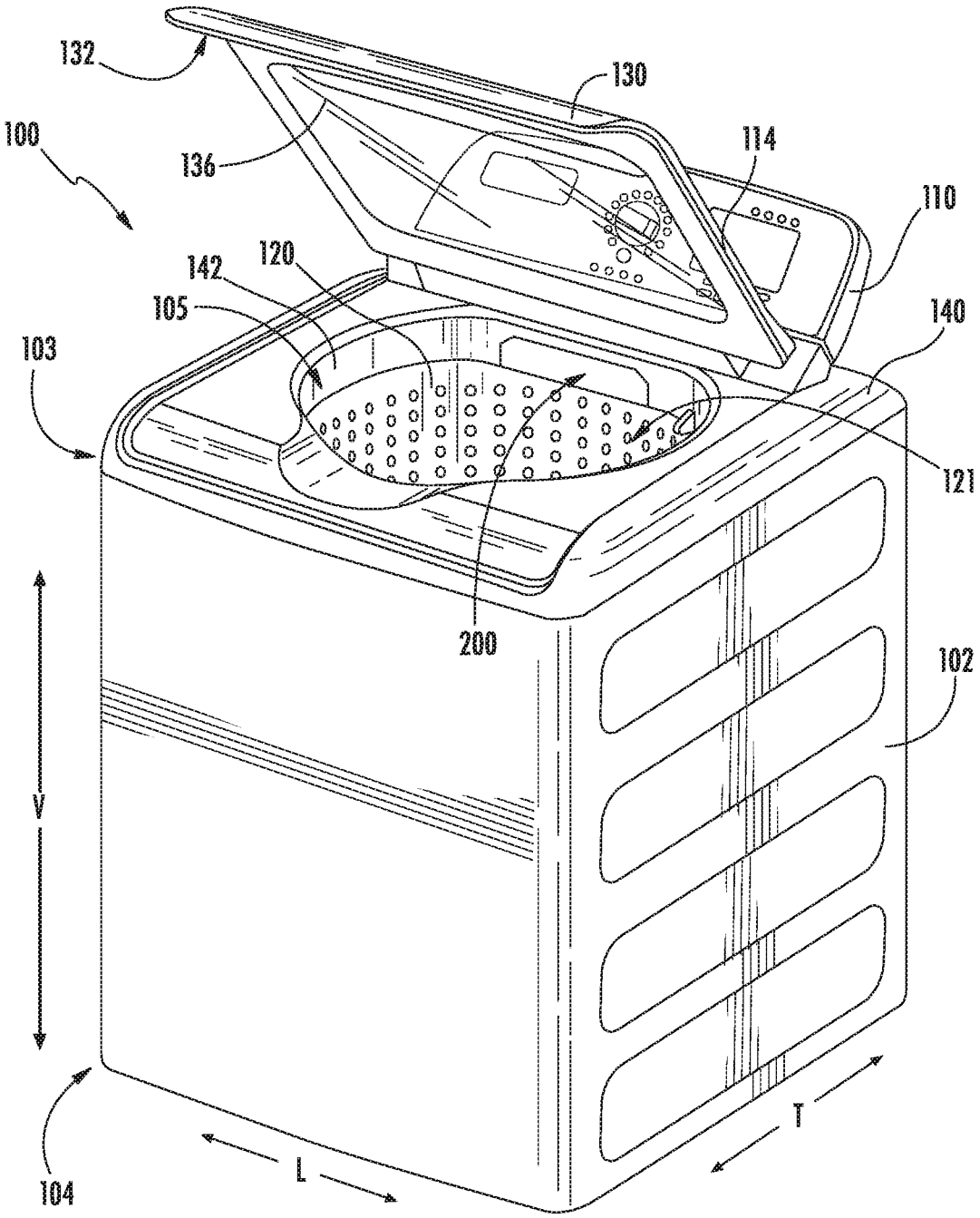
FIG. 2 provides a perspective view of the exemplary washing machine appliance of FIG. 1 with the door shown in an open position.
Figure 3:
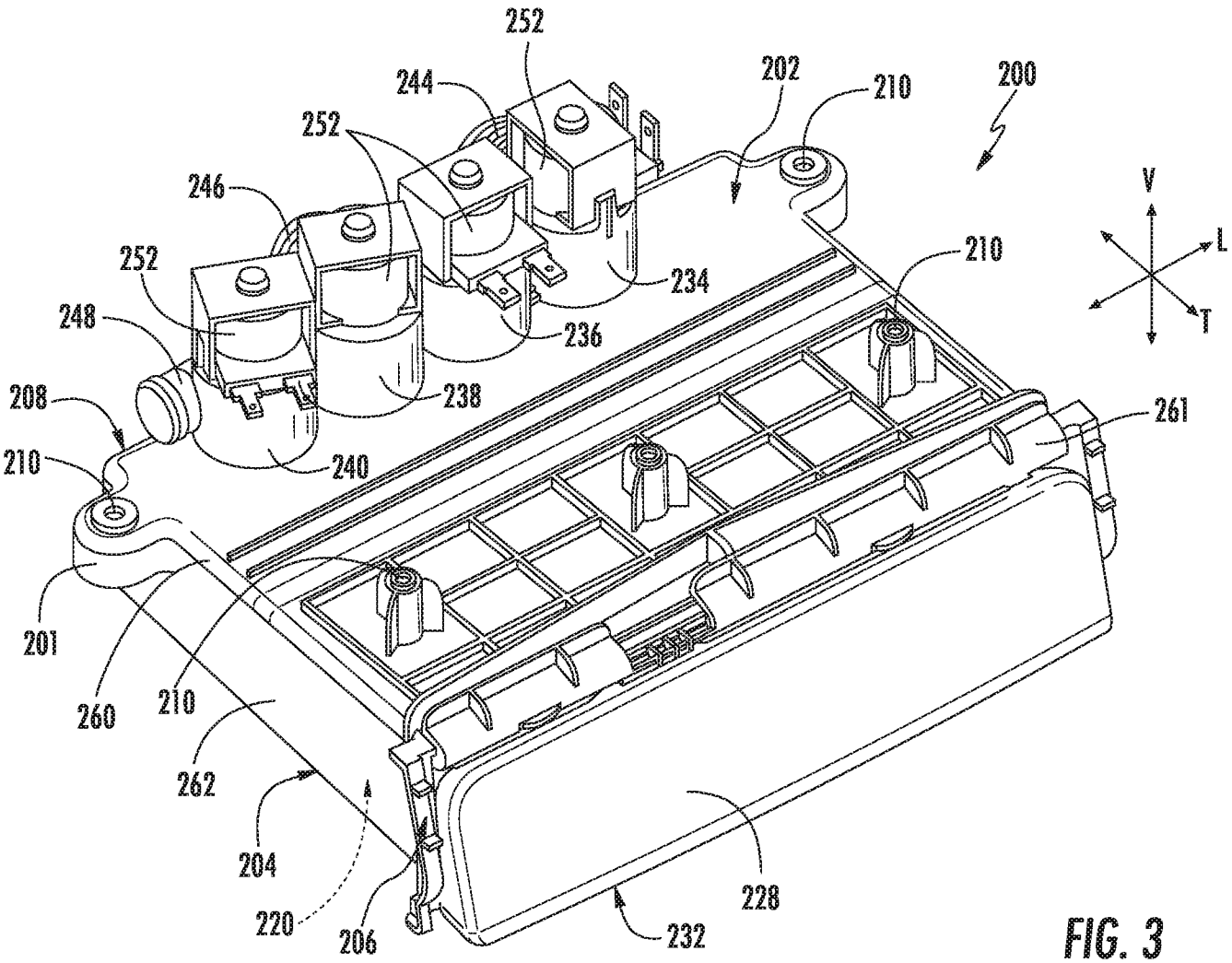
FIG. 3 provides a front, perspective view of an additive dispenser according to exemplary embodiments of the present disclosure.
Figure 4:
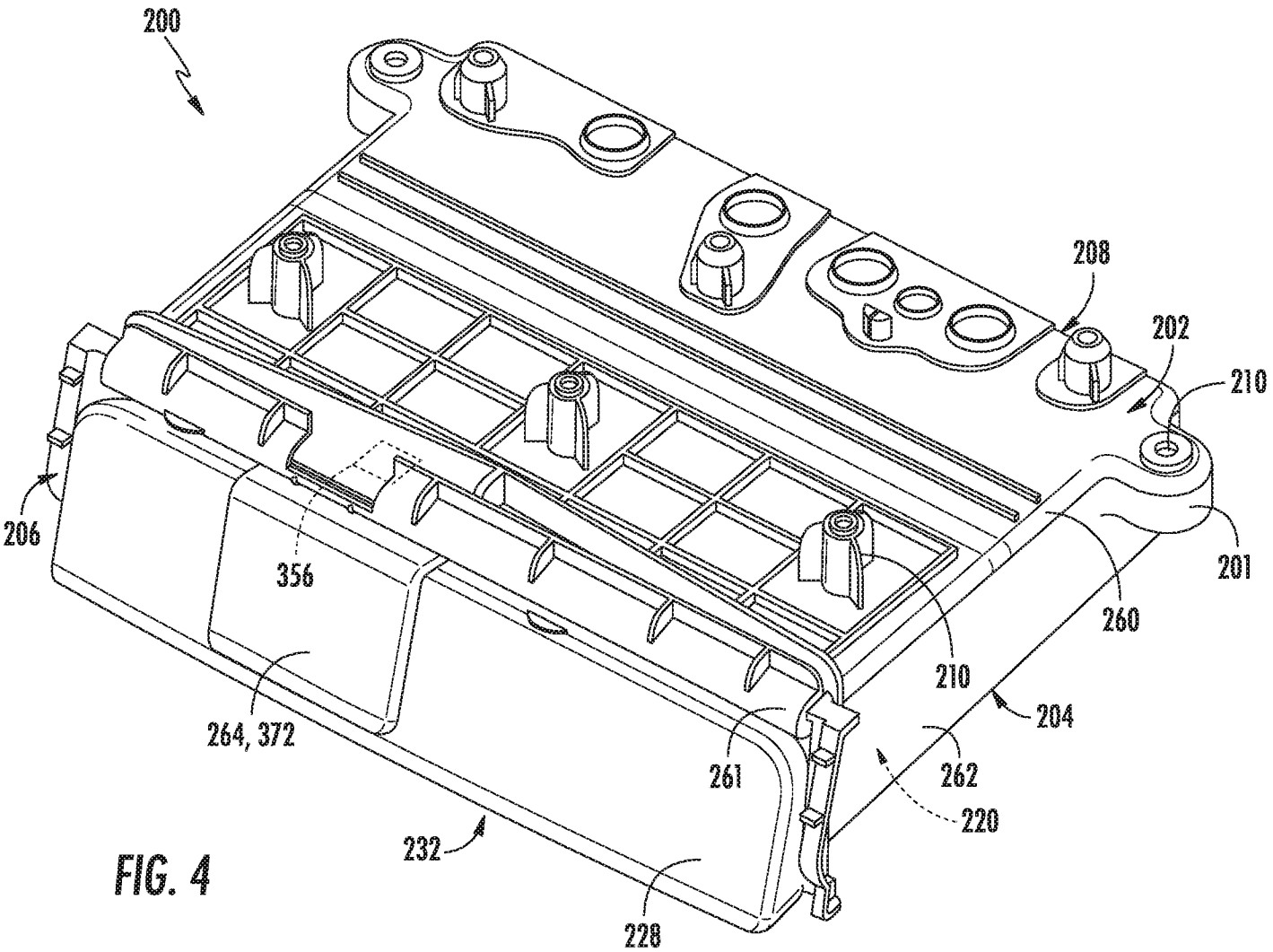
FIG. 4 provides a perspective view of portions of the exemplary additive dispenser of FIG. 3, wherein an additive pod cup has been provided.
Figure 5:
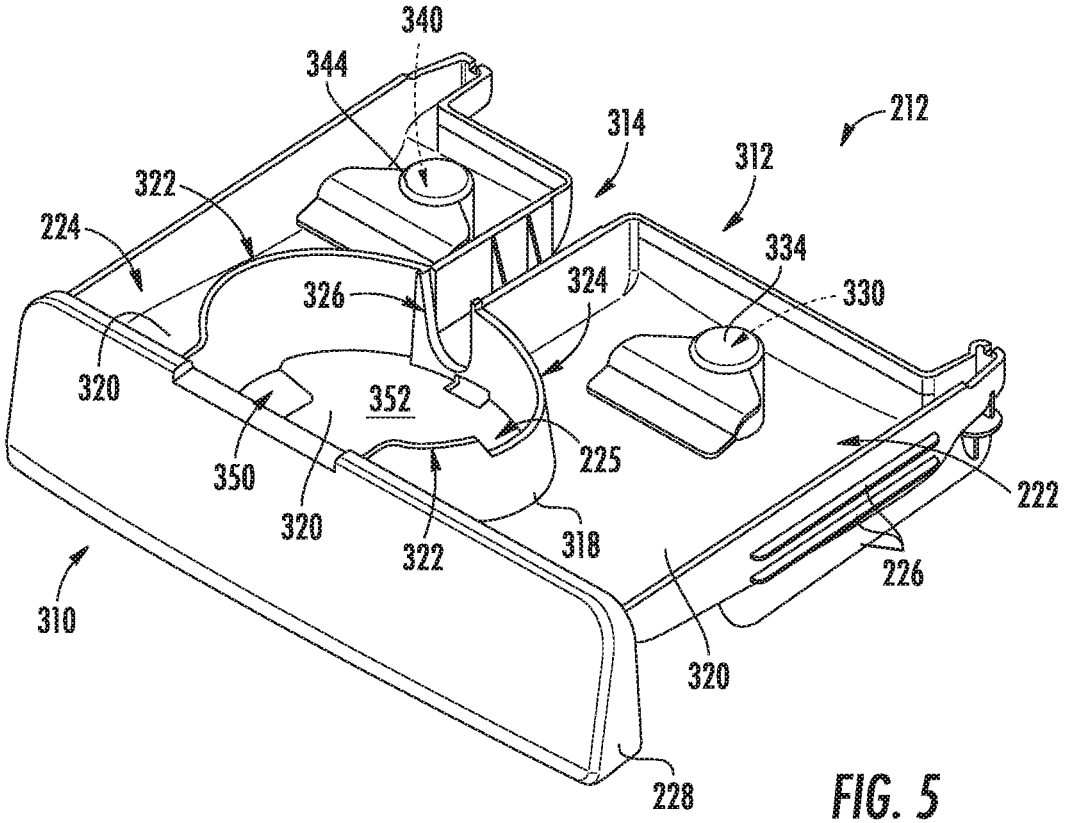
FIG. 5 provides a perspective view of a drawer of the exemplary additive dispenser of FIG. 3.
Figure 6:
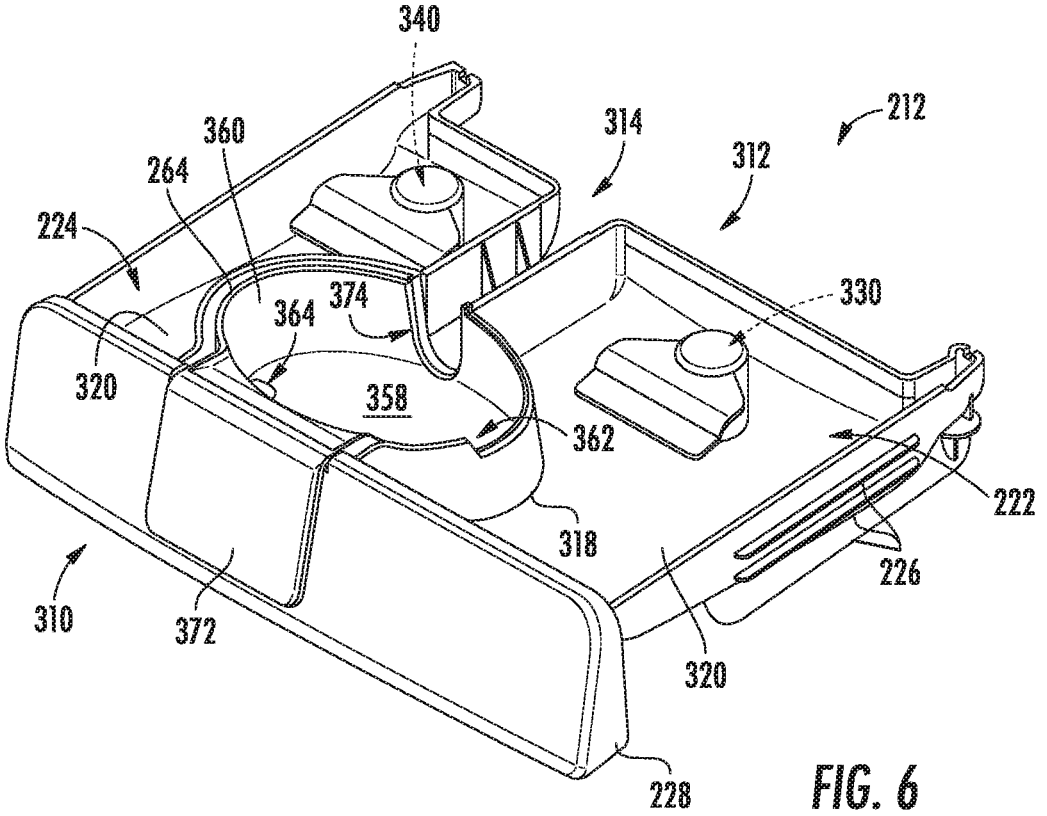
FIG. 6 provides a perspective view of a drawer of the exemplary additive dispenser of FIG. 3, wherein an additive pod cup has been provided.
Figure 7:
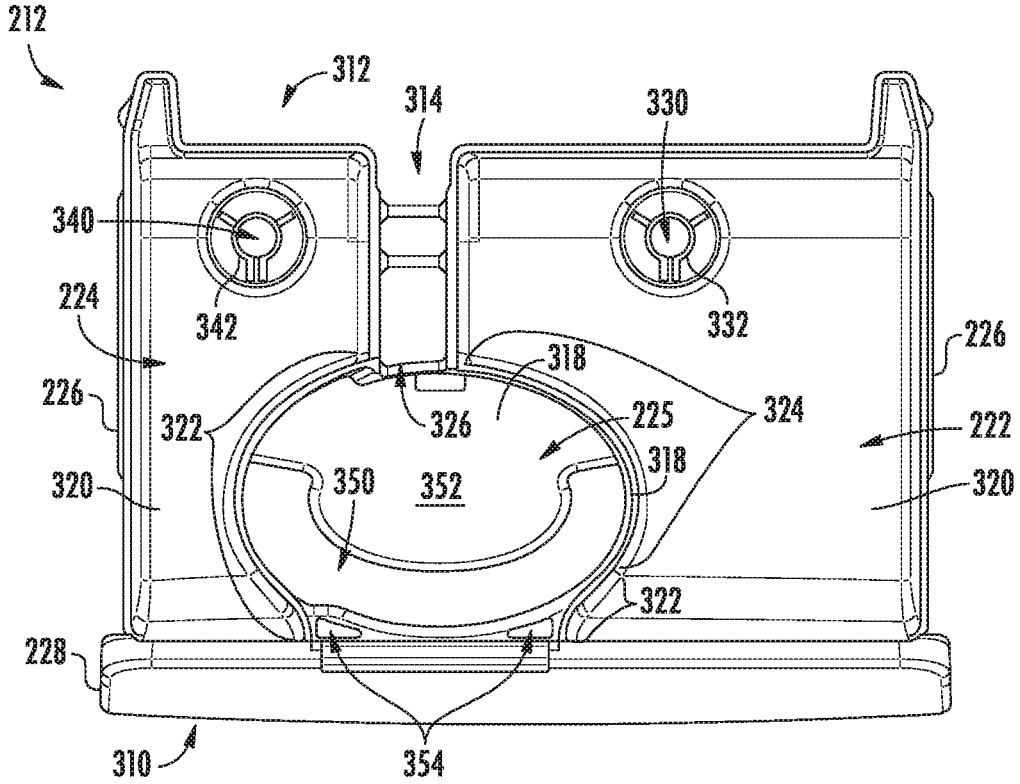
FIG. 7 provides a top plan view of the exemplary drawer of FIG. 5.
Figure 8:
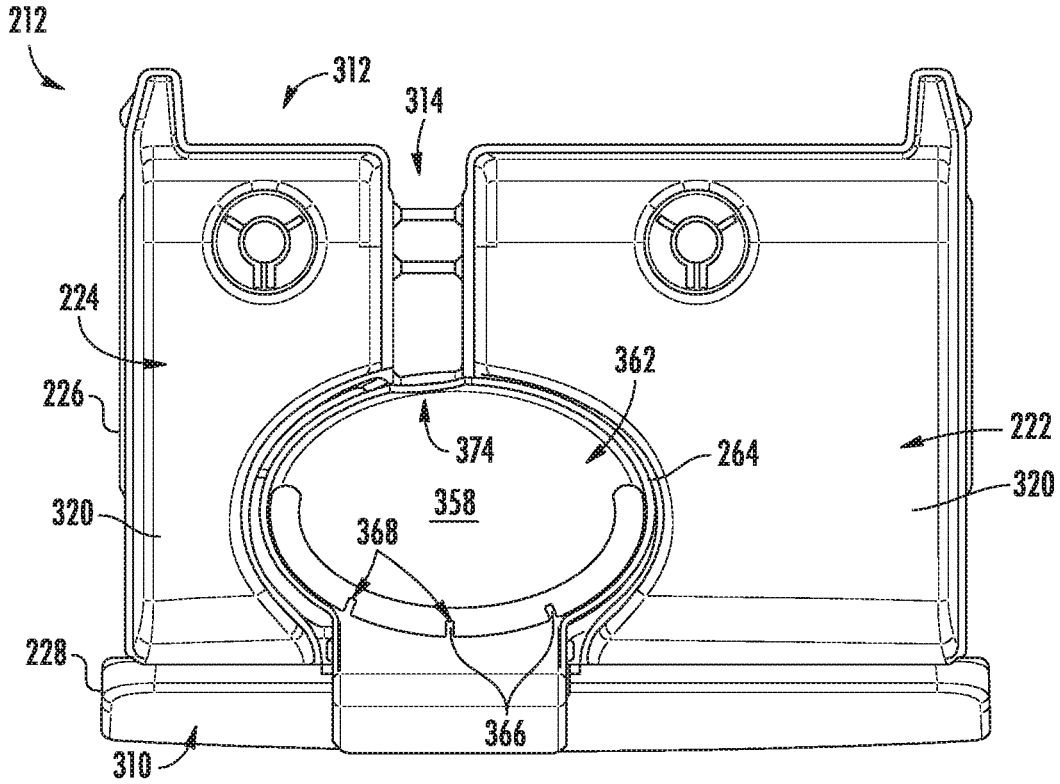
FIG. 8 provides a top plan view of the exemplary drawer of FIG. 6.
Figure 9:
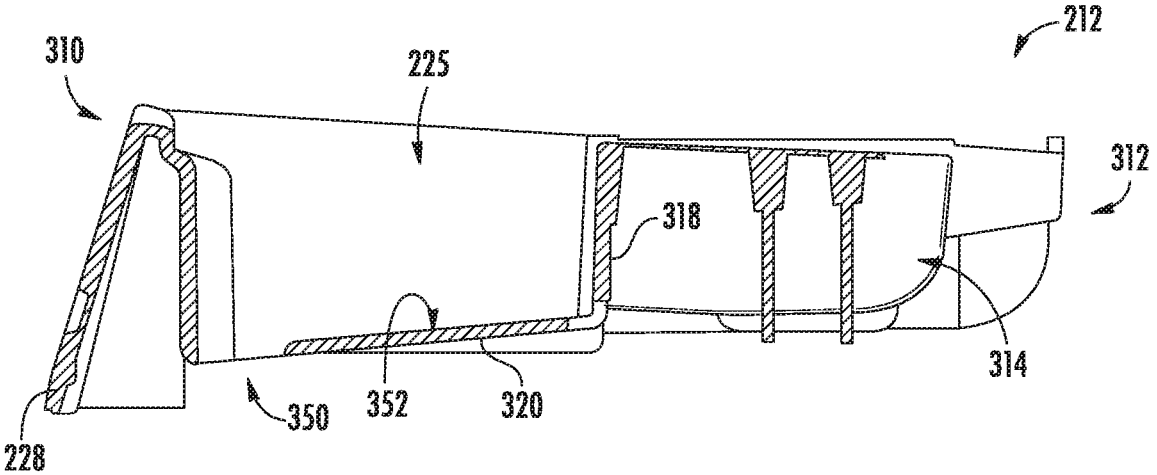
FIG. 9 provides side, sectional view of the exemplary drawer of FIG. 5.
Figure 10:
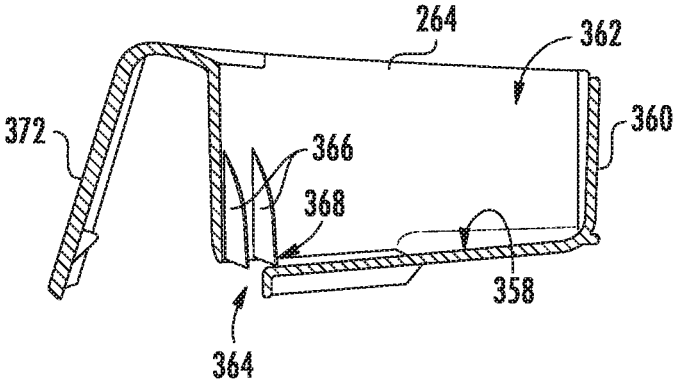
FIG. 10 provides side, sectional view of a pod cup of the exemplary drawer of FIG. 6.
Figure 11:
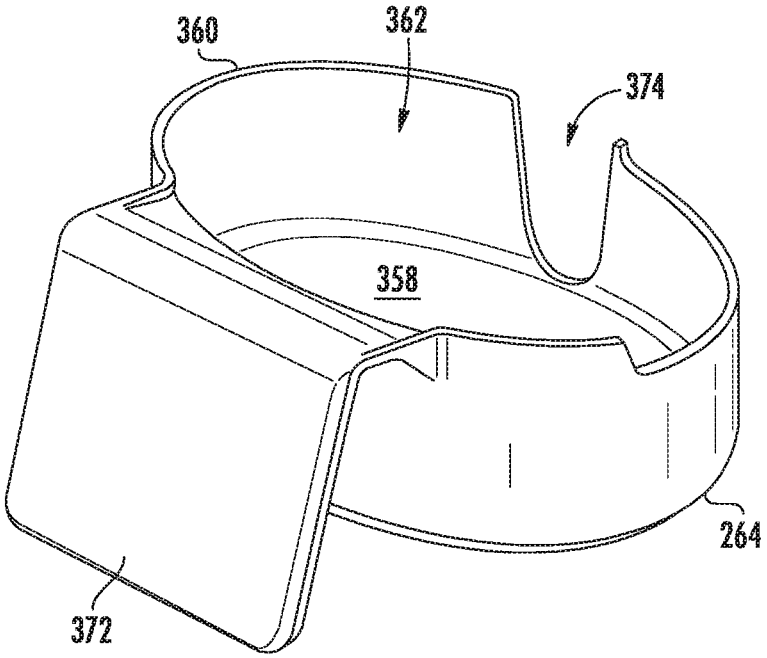
FIG. 11 provides a perspective view of a pod cup for an additive dispenser according to exemplary embodiments of the present disclosure.
Figure 12:
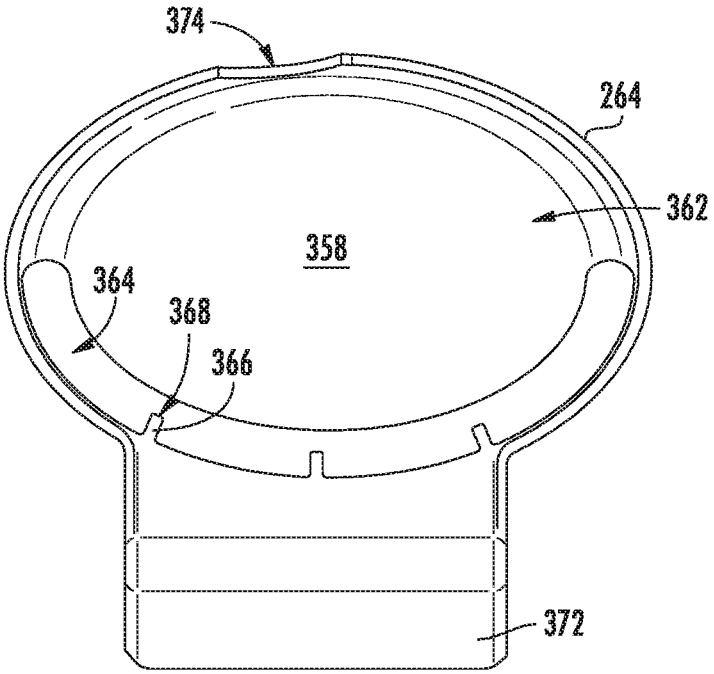
FIG. 12 provides a top plan view of the exemplary pod cup of FIG. 11.
Figure 13:
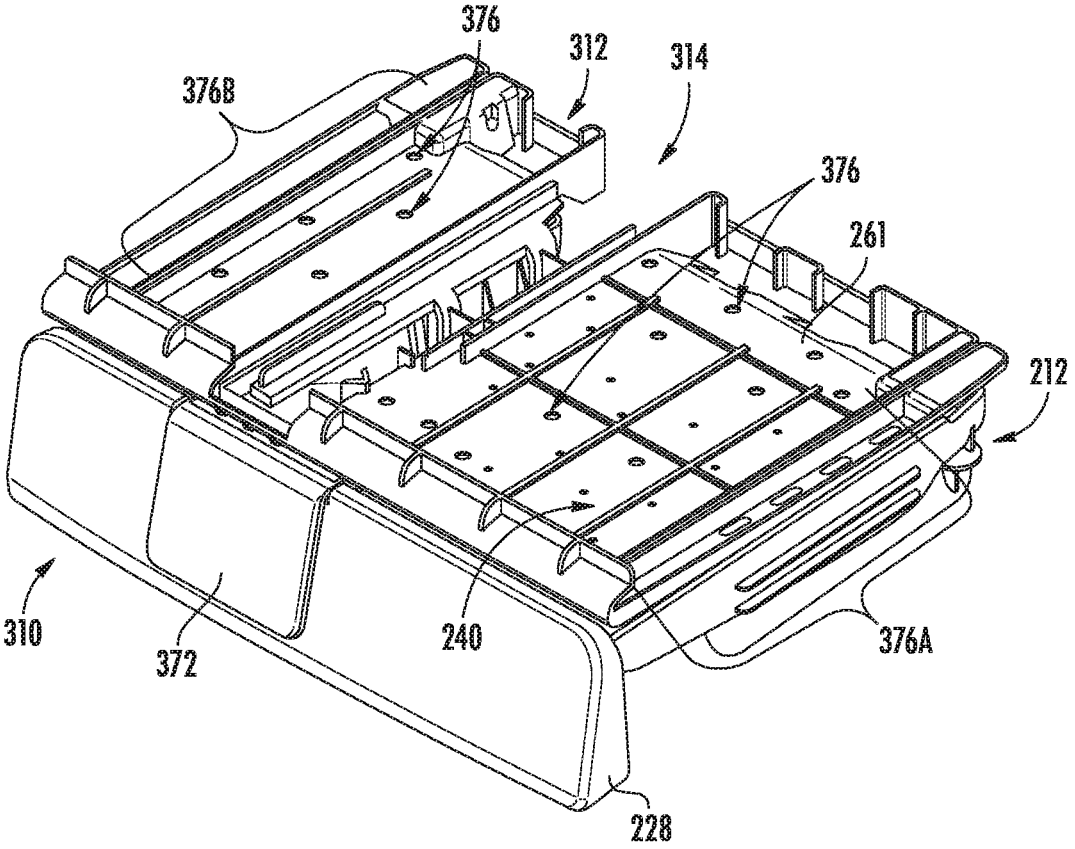
FIG. 13 provides a perspective view of portions of an additive dispenser, including a drawer and shower plate, according to exemplary embodiments of the present disclosure.
Figure 14:
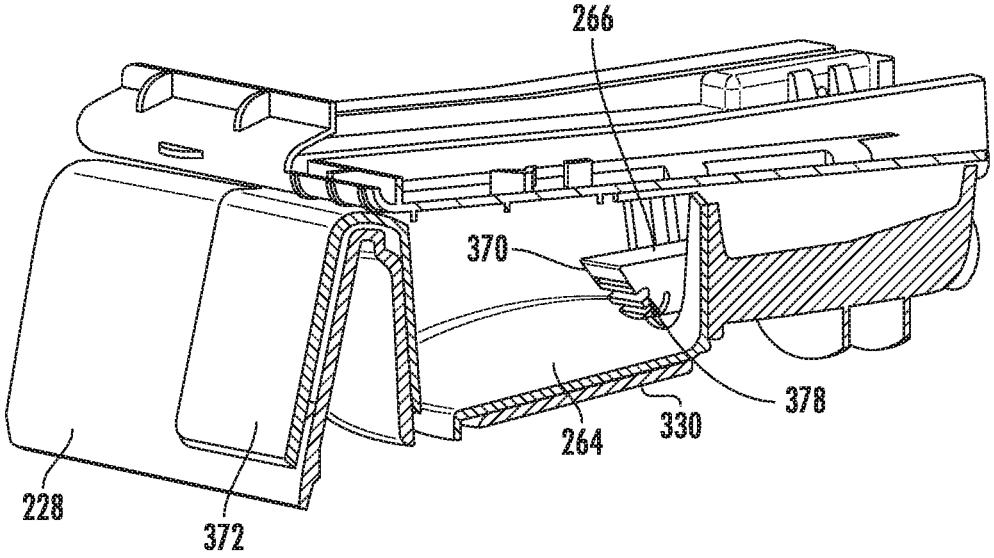
FIG. 14 provides a perspective, sectional view of the exemplary drawer and shower plate of FIG. 13.
Figure 15:
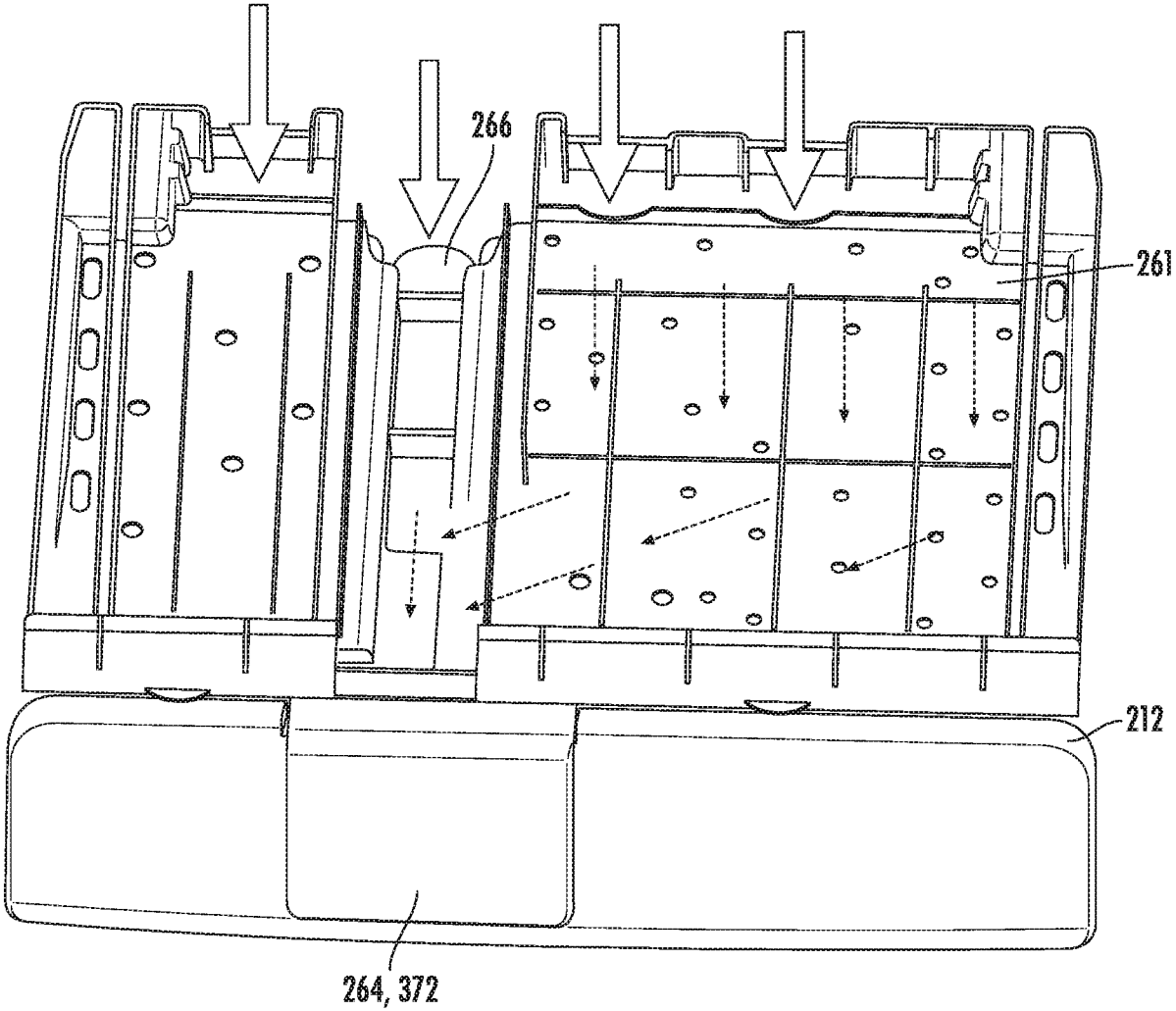
FIG. 15 provides a top, perspective view of the exemplary drawer and shower plate of FIG. 13.
Figure 16:
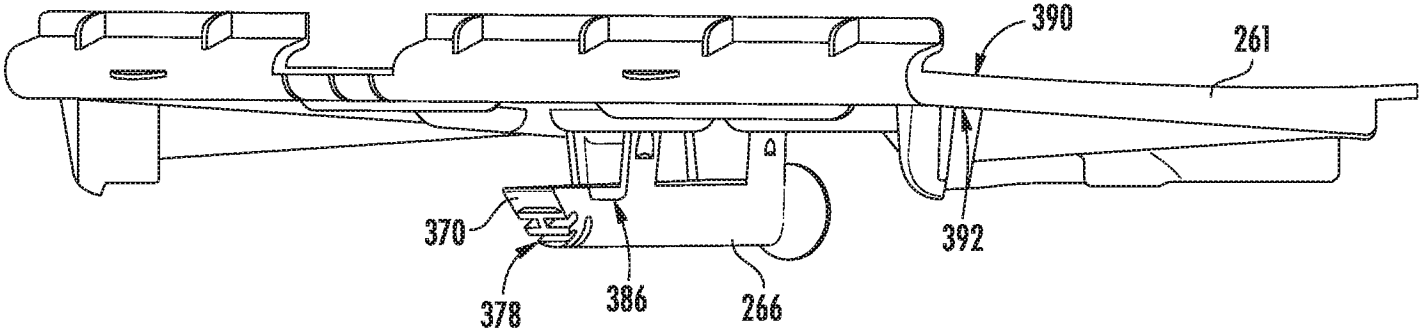
FIG. 16 provides a perspective view of portions of a shower plate of an additive dispenser according to exemplary embodiments of the present disclosure.
Figure 17:
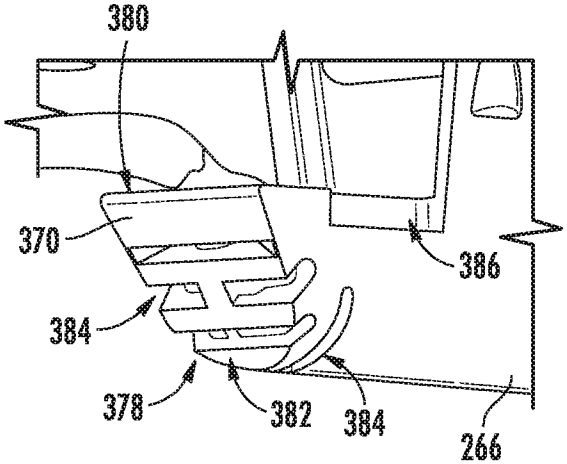
FIG. 17 provides a magnified, perspective view of a portion of the exemplary shower plate of FIG. 16.
Figure 18:
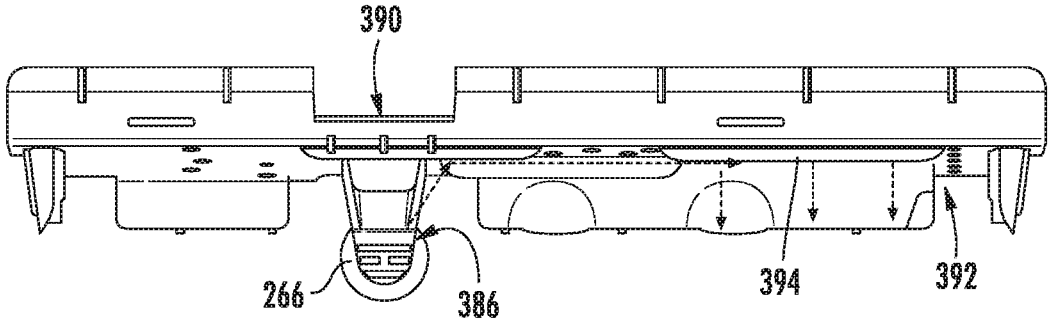
FIG. 18 provides a front, elevation view of the exemplary shower plate of FIG. 16.
Figure 19:
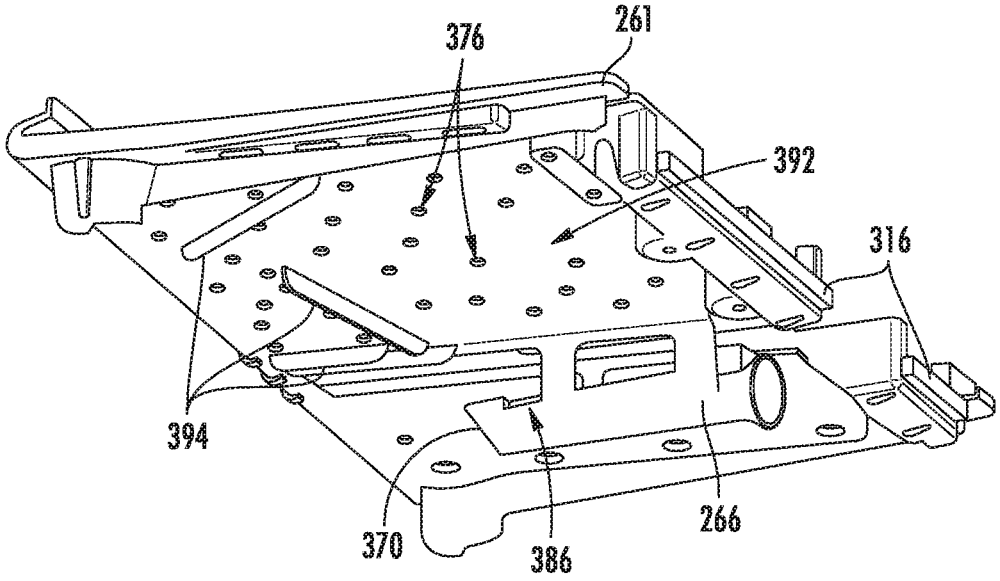
FIG. 19 provides a bottom, perspective view of the exemplary shower plate of FIG. 16.

Turning now to the figures, FIGS. 1 and 2 illustrate an exemplary embodiment of a washing appliance. Specifically, the washing appliance is illustrated as a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is defined.

While described in the context of a specific embodiment of vertical axis washing machine appliance 100, using the teachings disclosed herein it will be understood that vertical axis washing machine appliance 100 is provided by way of example only. Other washing appliances having different configurations, different appearances, or different features may also be utilized with the present subject matter as well (e.g., horizontal axis washing machines).

Washing machine appliance 100 has a cabinet 102 that extends between a top portion 103 and a bottom portion 104 along the vertical direction V. A wash basket 120 is rotatably mounted within cabinet 102. A motor (not shown) may be in mechanical communication with wash basket 120 to selectively rotate wash basket 120 (e.g., about a rotation axis during an agitation or a rinse cycle of washing machine appliance 100). Wash basket 120 is received within a wash tub 121 and is configured for receipt of articles for washing. The wash tub 121 holds wash and rinse fluids for agitation in wash basket 120 within wash tub 121. In optional embodiments, an agitator or impeller (not shown) extends into wash basket 120 and is also in mechanical communication with the motor. The impeller may assist agitation of articles disposed within wash basket 120 during operation of washing machine appliance 100.

In some embodiments, cabinet 102 of washing machine appliance 100 has a top panel 140. Top panel 140 defines an opening 105 that permits user access to wash basket 120 of wash tub 121. Door 130, which may be rotatably mounted to top panel 140, permits selective access to opening 105. In particular, door 130 selectively rotates between the closed position shown in FIG. 1 and the open position shown in FIG. 2. In the closed position, door 130 inhibits access to wash basket 120. Conversely, in the open position, a user can access wash basket 120. In optional embodiments, a window 136 in door 130 permits viewing of wash basket 120 when door 130 is in the closed position (e.g., during operation of washing machine appliance 100). Door 130 also includes a handle 132 that, for example, a user may pull or lift when opening and closing door 130. Further, although door 130 is illustrated as mounted to top panel 140, alternatively, door 130 may be mounted to another portion of cabinet 102 or any other suitable support.

In certain embodiments, a control panel 110 with at least one input selector 112 extends from top panel 140. Control panel 110 and input selector 112 collectively form a user interface input for operator selection of machine cycles and features. A display 114 of control panel 110 indicates selected features, operation mode, a countdown timer, or other items of interest to appliance users regarding operation. Operation of washing machine appliance 100 may be controlled by a controller or processing device 108 connected (e.g., electrically coupled) to control panel 110 for user manipulation to select washing machine cycles and features. In response to user manipulation of control panel 110, controller 108 operates the various components of washing machine appliance 100 to execute selected machine cycles and features.

Controller 108 may include a memory (e.g., non-transitive media) and microprocessor, such as a general or special purpose microprocessor operable to execute programming instructions or micro-control code associated with a selected machine cycles and features (e.g., as part of a washing operation, such as portions of methods 600 or 700). The memory may represent random access memory such as DRAM, or read only memory such as ROM or FLASH. In certain embodiments, the processor executes programming instructions stored in memory. The memory may be a separate component from the processor or may be included onboard within the processor. Alternatively, controller 108 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 110 and other components of washing machine appliance 100 (e.g., one or more sensors, such as a pressure sensor mounted to tub 121) may be in communication with controller 108 via one or more signal lines or shared communication busses.

In some embodiments, during operation of washing machine appliance 100, laundry items are loaded into wash basket 120 through opening 105, and a washing operation is initiated through operator manipulation of input selectors 112. Wash basket 120 or wash tub 121 is filled with water and detergent or other fluid additives via an additive dispenser 200, which will be described in detail below. One or more valves can be controlled by washing machine appliance 100 to provide for filling wash basket 120 to the appropriate level for the volume or number of articles being washed or rinsed. By way of example for a wash cycle, once wash tub 121 is properly filled with fluid, the contents of wash tub 121 can be agitated (e.g., with an impeller as discussed previously) for washing of laundry items in wash basket 120.

After the agitation phase of the wash cycle is completed, wash tub 121 can be drained. Laundry articles can then be rinsed (e.g., for a rinse cycle) by again adding fluid to wash basket 120 depending on the specifics of the washing operation selected by a user. The impeller may again provide agitation within wash basket 120. One or more spin cycles also may be used. In particular, a spin cycle may be applied after the wash cycle or after the rinse cycle to wring wash fluid from the articles being washed. During a spin cycle, wash basket 120 is rotated at relatively high speeds. After articles disposed in wash basket 120 are cleaned or washed, the user can remove the articles from wash basket 120 (e.g., by reaching into wash basket 120 through opening 105).

Referring now generally to FIGS. 2 through 6, additive dispenser 200 will be described in more detail. Although the discussion below refers to additive dispenser 200, one skilled in the art will appreciate that the features and configurations described may be used for other additive dispensers in other washing appliances as well. For example, additive dispenser 200 may be positioned on a front of cabinet 102, may have a different shape or chamber configuration, and may dispense water, detergent, or other additives. Other variations and modifications of the exemplary embodiment described below are possible, and such variations are contemplated as within the scope of the present subject matter.

In exemplary embodiments, additive dispenser 200 has a housing 201 that generally forms a box (e.g., having a substantially rectangular cross-section) defining a top 202 and a bottom 204 spaced apart along the vertical direction V. Additive dispenser 200 also defines a front end 206 and a rear end 208 spaced apart along the transverse direction T. In some such embodiments, front end 206 is open (e.g., to permit a dispenser drawer 212 or wash fluid therethrough) while rear end 208 is closed (e.g., thereby restricting the passage of wash fluid from housing 201 at rear end 208). In certain embodiments, additive dispenser 200 includes an upper top plate 260 fixed to a lower base plate 262, which together selectively enclose or receive a dispenser drawer 212.

In some embodiments, additive dispenser 200 is mounted underneath top panel 140 of cabinet 102 such that front side 206 is visible inside opening 105. More specifically, additive dispenser 200 may be mounted to top panel 140 using a plurality of mounting features 210, which may, for example, be configured to receive mechanical fasteners. One skilled in the art will appreciate that additive dispenser 200 may be mounted in other locations and use other mounting means according to alternative exemplary embodiments.

As shown, additive dispenser 200 may include or define a mixing chamber 220 configured to receive one or more additive compartments. For example, according to the illustrated embodiments, mixing chamber 220 is defined by top plate 260 and base plate 262. Together, top plate 260 and base plate 262 are configured to slidably receive a dispenser drawer 212 defining multiple additive compartments (e.g., 222, 224, 225).

As will be described in greater detail below, dispenser drawer 212 generally extends (e.g., along the transverse direction T) from a forward end 310 to a rearward end 312. When assembled, forward end 310 is generally positioned proximal to the rotation axis of basket 120 while rearward end 312 is positioned distal to the rotation axis of basket 120. Dispenser drawer 212 may define a primary (e.g., detergent) compartment 222, a secondary (e.g., softener or rinse) compartment 224, or a pod compartment 225. In some embodiments, compartments 222, 224, 225 are slidably connected to the mixing chamber 220 (e.g., as part of a dispenser drawer 212 having laterally-positioned or vertically-positioned slides 226) and are connected to a front panel 228 of additive dispenser 200. In certain embodiments, the dispenser drawer 212 is fixed to front panel 228 (e.g., to slide therewith along the transverse direction T). In this manner, a user may pull on front panel 228 to slide compartments 222, 224, 225 or dispenser drawer 212 along the transverse direction T from a closed position (e.g., FIGS. 3 and 4) to an open position (not pictured). Once extended, primary compartment 222 or secondary compartment 224 may be conveniently filled with a wash additive (e.g., liquid detergent, powder detergent, bleach, fabric softener, scent pellets, additive pods, rinse aid, etc.). Additionally or alternatively, pod compartment 225 maybe conveniently filled with one or more additive pods, either directly or, alternately, through a received pod cup 264.

From the open position, front panel 228 may then be pushed back into mixing chamber 220 (i.e., to the closed position) before a wash cycle begins. Along with permitting water into the compartments 222, 224, 225 the closed position of additive dispenser 200 may restrict or inhibit user access to the compartments 222, 224, 225.

Generally, housing 201 may define an exhaust opening 232 downstream from mixing chamber 220 or dispenser drawer 212 to direct wash fluid, such as water or a mixture of water and at least one wash additive (e.g., detergent, fabric softener, bleach, dissolved scent pellets, dissolved additive pod, etc.) into wash tub 121 from additive dispenser 200. In some embodiments, exhaust opening 232 is defined through the bottom of mixing chamber 220 (e.g., on or through a bottom surface of base plate 262) to dispense the wash fluid into wash tub 121. Optionally, exhaust opening 232 may be defined at an open front end 206. Additionally or alternatively, exhaust opening 232 may extend rearward from front end 206. When assembled such that dispenser drawer 212 is fully received within additive dispenser 200, at least a portion of dispenser drawer 212 may be positioned above and axially aligned with exhaust opening 232.

Additive dispenser 200 may further include one or more valves configured to supply hot or cold water to mixing chamber 220. For example, according to the illustrated embodiment, a plurality of apertures may be defined on top 202 of mixing chamber 220 (e.g., on shower plate 261) for receiving water. Each receiving aperture may be in fluid communication with a different portion of the mixing chamber 220. A plurality of valve seats may be positioned over the top of each of those apertures to receive a valve that controls the flow of water through each receiving aperture.

For example, a first valve seat 234 may be in fluid communication with a first aperture for providing hot water into primary compartment 222 or pod compartment 225. A second valve seat 236 may be in fluid communication with a second aperture for providing cold water into primary compartment 222 or pod compartment 225. A third valve seat 238 may be in fluid communication with a third aperture for providing cold water (or hot water) into pod compartment 225 (e.g., through a water supply conduit 266). A fourth valve seat 240 may be in fluid communication with a third aperture for providing cold water into secondary compartment 224.

Water inlets may be placed in fluid communication with each of valve seats 234, 236, 238, 240. More specifically, a hot water inlet 244 may be connected to a hot water supply line (not shown) and a cold water inlet 246 may be connected to a cold water supply line (not shown). According to the illustrated embodiment, each water inlet 244, 246 may include a threaded male adapter configured for receiving a threaded female adapter from a conventional water supply line. However, any other suitable manner of fluidly connecting a water supply line and water inlets 244, 246 may be used. For example, each water supply line and water inlets 244, 246 may have copper fittings that may be sweated together to create a permanent connection.

Notably, hot water inlet 244 is in direct fluid communication with first valve seat 234. However, because washing machine appliance 100 uses cold water for multiple purposes, cold water inlet is in fluid communication with a cold water manifold 248. Cold water manifold 248 may be a cylindrical pipe that extends along the lateral direction from second valve seat 236 to fourth valve seat 240. In this manner, cold water manifold 248 places valve seats 236, 238, 240 in fluid communication with cold water inlet 246.

Each of valve seats 234, 236, 238, 240 may be configured to receive a water valve 252 for controlling the flow of water through a corresponding aperture into mixing chamber 220. Water valve 252 may be, for example, a solenoid valve that is electrically connected to controller 108. However, any other suitable water valve may be used to control the flow of water. Controller 108 may selectively open and close water valves 252 to allow water to flow from hot water inlet 244 through first valve seat 234 and from cold water manifold 248 through one or more of second valve seat 236, third valve seat 238, and fourth valve seat 240.

Additive dispenser 200 may further include one or more supply conduits (e.g., water supply conduit 266) defining an internal water inlet (e.g., water inlet 378) within a specific compartment to direct water to that specific compartment (e.g., from one or more of the valves 252 or valve seats 234, 236, 238, 240). For example, when third valve seat 238 is open, water may flow from cold water inlet 246 through cold water manifold 248 and third valve seat 238 into water supply conduit 266 and then pod compartment 225. As will be described in greater detail below, water may dissolve an additive pod placed within pod compartment 225 upstream from wash tub 121 to create a wash liquid to be dispensed downstream from mixing chamber 220 and into wash tub 121.

In some embodiments, a shower plate 261 is mounted within mixing chamber 220 (e.g., fixedly mounted above compartments 222, 224) to distribute water therethrough. When assembled such that dispenser drawer 212 is fully received within additive dispenser 200, shower plate 261 may be positioned directly above dispenser drawer 212. Moreover, shower plate 261 may be directly beneath the valve seats 234, 236, 238, 240 and their corresponding openings through top plate 260.

Turning especially to FIGS. 4 through 12, portions of additive dispenser 200 are illustrated. In particular, an exemplary dispenser drawer 212 and pod cup 264 are illustrated (e.g., both separately and together). Generally, dispenser drawer 212 may be slidably mounted to housing 201 (e.g., top plate 260 or base plate 262) to move relative thereto (e.g., along the transverse direction T).

As shown, dispenser drawer 212 defines a discrete primary compartment 222 and pod compartment 225. Separate wash additives may thus be contained within primary compartment 222 and pod compartment 225 (e.g., a liquid or granular wash additive and additive pod, respectively). Both primary compartment 222 and pod compartment 225 are defined as open between the forward end 310 and rearward end 312. Pod compartment 225 may be adjacent (e.g., laterally adjacent) to primary compartment 222. Additionally or alternatively, pod compartment 225 may be disposed forward from at least a portion of primary compartment 222. During use, wash fluid from pod compartment 225 may be selectively dispensed (e.g., separately and at a different time/cycle from another wash fluid selectively dispensed from primary compartment 222).

In optional embodiments, a discrete secondary compartment 224 is further defined between forward end 310 and rearward end 312. As shown, secondary compartment 224 may be adjacent (e.g., laterally adjacent) to pod compartment 225 or opposite of primary compartment 222. Additionally or alternatively, an open void (e.g., lateral void 314 through which a water supply conduit 266 may extend) may separate primary and secondary compartments 222, 224 (e.g., with or in addition to pod compartment 225), advantageously preventing different wash additives from mixing or being exchanged between primary and secondary compartments 222, 224.

In some embodiments, an internal pod wall 318 at least partially defines pod compartment 225 (e.g., directly next to primary compartment 222). For instance, internal pod wall 318 may extend in the vertical direction V from a bottom wall 320 of dispenser drawer 212 (e.g., as an integral or unitary molded member). Additionally or alternatively, internal pod wall 318 may extend circumferentially (e.g., along an elliptical or oblong path) about the pod compartment 225. Pod compartment 225 may generally be disposed at or proximal to forward end 310. In some such embodiments, internal pod wall 318 is joined to, or included with, a portion of front panel 228.

While a bottom portion of internal pod wall 318 is joined to bottom wall 320, the top portion of internal pod wall 318 may define an opening through which a user may place one or more additive pods. Pod compartment 225 may thus form an open pocket (e.g., within which an additive pod or cup may be received). In some embodiments, the top portion of internal pod wall 318 is defined at multiple discrete heights. Thus, at least one segment of internal pod wall 318 may extend to a greater vertical height or distance (e.g., relative to the lowermost internal surface of pod compartment 225 or primary compartment 222). For instance, internal pod wall 318 may have a tall wall segment 322 and a short wall segment 324, which extends to a lower height than tall wall segment 322. Optionally, tall wall segment 322 may extend to a bottom side 392 of shower plate 261 while short wall segment 324 is vertically spaced apart from shower plate 261.

As shown, tall wall segment 322 extends circumferentially about a first portion of the pod compartment 225 (i.e., part of the perimeter of pod compartment 225). In some such embodiments, tall wall segment 322 is disposed between pod compartment 225, secondary compartment 224, or a portion of primary compartment 222 (e.g., less than all of the primary compartment 222 that is separated from pod compartment 225 by internal pod wall 318). Tall wall segment 322 may thus serve as a vertical barrier between fluids or wash additives in pod compartment 225 and secondary compartment 224 (or a portion of primary compartment 222). Short wall segment 324 extends circumferentially along a second portion of pod compartment 225. In some such embodiments, short wall segment 324 is disposed between pod compartment 225 and primary compartment 222 (e.g., all or some of the primary compartment 222 that is separated from pod compartment 225 by internal pod wall 318). During use, as water or wash fluid within primary compartment 222 rises to a level greater than or equal to short wall segment 324, some of the water or wash fluid may be advantageously permitted to flow over short wall segment 324 and into pod compartment 225 (e.g., to selectively wet an additive pod or clear residue from pod compartment 225).

In certain embodiments, internal pod wall 318 defines a conduit passage 326 through which a water supply conduit 266 may be selectively received. Conduit passage 326 may, for example, be defined at a rearward portion of pod compartment 225 (e.g., opposite a forward portion or front panel 228). In some such embodiments, conduit passage 326 is defined as an aperture that is horizontal or perpendicular to the vertical direction V. For instance, conduit passage 326 may extend along the transverse direction T through internal pod wall 318. Moreover, conduit passage 326 may define a lateral width or diameter that is greater than the width or diameter of water supply conduit 266. Optionally, conduit passage 326 may be transversely aligned with (e.g., forward from) lateral void 314.

Each compartment 222, 224, or 225 defines at least one corresponding outlet upstream from exhaust opening 232 or mixing chamber 220 to direct one or more wash fluids to basket 120. In some embodiments, dispenser drawer 212 defines a primary outlet 330 extending vertically from primary compartment 222 (e.g., to direct a primary wash fluid to basket 120); a secondary outlet 340 extending vertically from secondary compartment 224 (e.g., to direct a secondary wash fluid to basket 120); and a pod outlet 350 extending vertically from pod compartment 225 (e.g., to direct a dissolved pod wash fluid to basket 120).

In some embodiments, a primary siphon tube 332 is provided within primary compartment 222 to define primary outlet 330. Primary siphon tube 332 may extend upward from bottom wall 320 (e.g., at a portion of primary compartment 222 proximal to rearward end 312). In particular, primary siphon tube 332 may extend to an open end maintained at a maximum liquid height (e.g., less than or equal to the height of short wall segment 324). Liquid additive within primary compartment 222 may thus be held therein below the maximum liquid height. In some embodiments, a primary fill cap 334 is disposed on primary siphon tube 332 at the open end (e.g., to facilitate a siphoning action through primary siphon tube 332). Optionally, primary fill cap 334 may indicate that liquid within primary compartment 222 has nearly exceeded the maximum liquid height. As would be understood, primary fill cap 334 may define a radial channel about primary siphon tube 332 such that liquid rising above the maximum liquid height may be permitted to pass through the radial channel and to primary outlet 330 by a siphoning action.

In additional or alternative embodiments, a secondary siphon tube 342 is provided within secondary compartment 224 to define secondary outlet 340. Secondary siphon tube 342 may extend upward from bottom wall 320 (e.g., at a portion of secondary compartment 224 proximal to rearward end 312). In particular, secondary siphon tube 342 may extend to an open end maintained at a maximum liquid height (e.g., less than the height of tall wall segment 322). Liquid additive within secondary compartment 224 may thus be held therein below the maximum liquid height. In some embodiments, a secondary fill cap 344 is disposed on secondary siphon tube 342 at the open end (e.g., to facilitate a siphoning action through secondary siphon tube 342). Optionally, secondary fill cap 344 may indicate that liquid within secondary compartment 224 has nearly exceeded the maximum liquid height. As would be understood, secondary fill cap 344 may define a radial channel about secondary siphon tube 342 such that liquid rising above the maximum liquid height may be permitted to pass through the radial channel and to secondary outlet 340 by a siphoning action.

In further additional or alternative embodiments, dispenser drawer 212 defines pod outlet 350 vertically through bottom wall 320. For instance, pod outlet 350 may be defined as an opening through bottom wall 320 at forward end 310 (e.g., at a portion of bottom wall 320 proximal to forward end 310 or a forwardmost portion of pod compartment 225). Pod outlet 350 and, optionally, pod compartment 225 may further be defined forward from primary outlet 330 or secondary outlet 340. In some embodiments, the bottom surface 352 of pod compartment 225 may be sloped (e.g., downward from rearward end 312 to forward end 310). Thus, pod outlet 350 may be disposed lower than a rear portion of bottom wall 320 within pod compartment 225 (e.g., to generally direct water or wash fluid along bottom surface 352 toward forward end 310).

Generally, pod outlet 350 may be defined with any suitable profile or cross-sectional area (e.g., perpendicular to the vertical direction V). In the illustrated embodiments, pod outlet 350 is defined as a curved arc (i.e., according to an arcuate profile or outline in the plane perpendicular to the vertical direction V). In some such embodiments, the tip or crest of the curved arc is disposed proximal to forward end 310 (i.e., forward from the two endpoints of the arc).

Optionally, one or more drain holes 354 may be defined through a portion of the wall at pod compartment 225. For instance, the drain apertures 354 may be defined through a front portion of internal pod wall 318. Additionally or alternatively, drain holes 354 may be horizontally spaced apart from pod outlet 350. In particular, drain holes 354 may be forward from pod outlet 350 (e.g., at opposite lateral sides of the tip of the curved arc). During use, excess wash fluid or water remaining within pod compartment 225 may thus drain to mixing chamber 220 or wash tub 121 (FIG. 2) through drain holes 354.

When assembled such that dispenser drawer 212 is fully received within additive dispenser 200, pod outlet 350 may be positioned directly above basket 120. For instance, pod outlet 350 may be above and axially aligned with exhaust opening 232. Wash fluid exiting pod outlet 350 may thus flow directly through exhaust opening 232 (e.g., and into basket 120) without collecting first within mixing chamber 220 or on an internal surface of housing 201. By contrast, primary outlet 330 or secondary outlet 340 may be positioned within housing 201 rearward from exhaust opening 232. Primary outlet 330 or secondary outlet 340 may be enclosed within housing 201. Wash fluid exiting primary outlet 330 or secondary outlet 340 may thus flow to mixing chamber 220 (e.g., collect on a lower internal surface of housing 201) before flowing through exhaust opening 232 (e.g., and into basket 120).

In optional embodiments, additive dispenser 200 includes an optical sensor 356 directed at pod compartment 225. For instance, optical sensor 356 may be mounted to housing 201 above dispenser drawer 212 or shower plate 261. In some such embodiments, optical sensor 356 is attached to top plate 260. A corresponding vertical channel may thus permit an uninterrupted line of sight therethrough. When assembled such that dispenser drawer 212 is fully received within additive dispenser 200, optical sensor 356 may be disposed above pod compartment 225 to detect an optically-observed condition (e.g., pod characteristic) thereof.

Optical sensor 356 may be a camera or any type of device suitable for capturing a two-dimensional picture or image. As an example, optical sensor 356 may be a video camera or a digital camera with an electronic image sensor [e.g., a charge coupled device (CCD) or a CMOS sensor]. When assembled, optical sensor 356 is in communication (e.g., electrically or wirelessly coupled) with controller 108 such that controller 108 may receive an image signal from optical sensor 356 corresponding to the image captured by optical sensor 356, as is understood. From the received image signals, controller 108 may be configured to determine a pod characteristic of pod compartment 225 (e.g., how many additive pods, what type of additive pod(s), or whether any undissolved portions of an additive pod are within pod compartment 225). For instance, additive pods (or portions thereof) within the field of view for the optical sensor 356 may be automatically identified by the controller 108. As is understood, recognizing or identifying such items, may be performed by edge matching, divide-and-conquer search, greyscale matching, histograms of receptive field responses, or another suitable routine (e.g., executed at controller 108 based on one or more captured images from optical sensor 356).

As shown, in certain embodiments, a pod cup 264 can be selectively received on dispenser drawer 212 within pod compartment 225. Thus, a user may insert pod cup 264 into pod compartment 225 and remove pod cup 264 from pod compartment 225 as desired (e.g., based on the type or number additive pods to be used in a given washing operation).

As shown, pod cup 264 generally includes one or more cup walls (e.g., base wall 358 and cup sidewalls 360) defining an open pod chamber 362. Specifically, the cup walls provide an inner surface that may form a recessed profile that delineates or bounds open pod chamber 362 to hold an additive pod therein (e.g., complementary to pod compartment 225).

The pod cup 264 generally defines at least one vertical opening 364 through which a dissolved additive may be permitted to flow (e.g., with water as part of a wash fluid) to or through the pod compartment 225 upstream from pod outlet 350. Generally, the vertical opening 364 of pod cup 264 may be defined with any suitable profile or cross-sectional area (e.g., perpendicular to the vertical direction V). In the illustrated embodiments, the vertical opening 364 is defined as a curved arc (i.e., according to an arcuate profile or outline in the plane perpendicular to the vertical direction V). In some such embodiments, the tip or crest of the curved arc is disposed proximal to forward end 310 (i.e., forward from the two endpoints of the arc).

In some embodiments, base wall 358 of pod cup 264 is sloped (e.g., downward from a rearward portion to forward portion). Thus, vertical opening 364 may be disposed lower than a rear portion of base wall 358 (e.g., to generally direct water or wash fluid along base wall 358 toward forward end 310 within open pod chamber 362).

Optionally, one or more support posts 366 may extend (e.g., horizontally) across a portion of vertical opening 364. For instance, multiple support posts 366 (e.g., three or more support posts 366) may be spaced apart (e.g., circumferentially) from each other and extend from a forward edge of vertical opening 364 or inner forward surface of cup sidewall 360. In some such embodiments, the circumferential or horizontal distance between each adjacent support post 366 is less than or equal to 3.8 centimeters. Such support posts 366 may include corresponding free ends 368 that are spaced apart from the rearward edge of vertical opening 364. In other words, support posts 366 may extend horizontally across a portion (e.g., less than the entire horizontal width or depth) of vertical opening 364. Additionally or alternatively, one or more support posts 366 may be sloped downward to free end 368 or vertical opening 364. Thus, the inward-facing edge of support post 366 may generally define a negative curve in the distance from the inner forward surface of cup sidewall 360 to the free end 368. Advantageously, an undissolved additive pod within open pod chamber 362 may be prevented from passing through vertical opening 364 while partially-dissolved pod casings or portions may be permitted therethrough (e.g., without being caught or stuck by support posts 366).

As shown, a front flap 372 may extend forward from cup sidewall(s) 360. For example, front flap 372 may be formed with an inner profile that is complementary to front panel 228 to rest thereon. Additionally or alternatively, a cup sidewall 360 may define an interior passage 374 through which water supply conduit 266 may be selectively received (e.g., when received through conduit passage 326). Interior passage 374 may, for example, be defined at a rearward portion of pod cup 264 (e.g., opposite a forward portion or front flap 372). In some such embodiments, interior passage 374 is defined as an aperture that is horizontal or perpendicular to the vertical direction V. For instance, interior passage 374 may extend along the transverse direction T through sidewall 360. Moreover, interior passage 374 may define a lateral width or diameter that is greater than or equal to the width or diameter of conduit passage 326.

When assembled such that pod cup 264 is received within pod compartment 225, the vertical opening 364 may be aligned with (e.g., above) pod outlet 350 and exhaust opening 232. Pod outlet 350 may be aligned below the vertical opening 364 of pod cup 264. The cross section of the vertical opening 364 of pod cup 264 may mirror or be coaxial with the cross section of pod outlet 350. Moreover, the cross section of the vertical opening 364 of pod cup 264 may smaller than the cross section of pod outlet 350. Furthermore, interior passage 374 may be aligned with conduit passage 326 such that water supply conduit 266 may be received therethrough (e.g., and extend into pod chamber 362).

In certain embodiments, pod cup 264 can be selectively received on dispenser drawer 212 within pod compartment 225. Optionally, pod cup 264 can be provided as part of a dispenser kit and can be exchanged for other cups, or held outside of dispenser drawer 212 (e.g., when not required or desired). Thus, additive dispenser 200 may operate in multiple discrete conditions (e.g., based on the type wash additive to be used within primary compartment 222 for a given washing operation).

One condition may be a general or small-pod condition (e.g., for an additive pod as a first additive—FIGS. 6 and 8) including pod cup 264 on dispenser drawer 212 within pod compartment 225 to receive an additive pod therein. Another condition may be a special or large-pod condition (e.g., a relatively large additive pod or multiple additive pods as the first additive—FIGS. 5 and 7) wherein no cup is within pod compartment 225. The first wash additive may be supplied directly to the bottom surface 352 of pod compartment 225. In the special or large-pod condition, pod cup 264 is generally unused and, thus, may be held apart from or outside of additive dispenser 200.

Selective use or nonuse of pod cup 264 may advantageously permit different wash additives to be supplied, preloaded, or otherwise used within corresponding primary compartment 222 (e.g., to ensure such wash additives are appropriately stored within and dispensed from dispenser drawer 212). Moreover, additive pods may be selectively loaded apart from additive dispenser 200.

Turning now to FIGS. 13 through 19, various views are provided of certain portions of additive dispenser 200. In particular, shower plate 261 is further illustrated according to exemplary embodiments. As noted above, shower plate 261 may be mounted within mixing chamber 220 to selective distribute water to one or more compartments of dispenser drawer 212.

As shown, shower plate 261 defines a plurality of water apertures 376 downstream from the valve seats (e.g., one or more of 234, 236, or 240). Such water apertures 376 may generally extend vertically through shower plate 261 from a top side 390 to a bottom side 392. As an example, a primary set 376A of the water apertures 376 may be disposed above primary compartment 222. As water flows from the water intake (e.g., through top plate 260), shower plate 261 may direct at least a portion of the water through the primary set 376A of the water apertures 376 to primary compartment 222. Thus, the primary set 376A may be in fluid communication between the water intake and primary compartment 222 (e.g., downstream of valve seat 234 or 236). Within primary compartment 222, water from the primary set 376A of the water apertures 376 may mix with or dissolve a granular or liquid wash additive (e.g., detergent) before being dispensed to wash tub 121 (e.g., as a wash fluid through exhaust opening 232). Optionally, a portion of the water or wash fluid within primary compartment 222 may flow over short wall segment 324 of internal pod wall 318, thereby providing pod chamber 362 downstream of primary compartment 222 and valve seat(s) 234 or 236. Additionally or alternatively, at least a portion of the water along shower plate 261 may be guided (e.g., directly) to pod compartment 225 without first flowing to primary compartment 222. In some such embodiments, one or more water apertures 376 are defined, for instance, directly above pod compartment 225.

As an additional or alternative example, a secondary set 376B of the water apertures 376 may be disposed above secondary compartment 224. As water flows from the water intake (e.g., through top plate 260), shower plate 261 may direct at least a portion of the water through the secondary set 376B of the water apertures 376 to secondary compartment 224. Thus, the secondary set 376B may be in fluid communication between the water intake and secondary compartment 224 (e.g., downstream of valve seat 240). Within secondary compartment 224, water from the secondary set 376B of the water apertures 376 may mix with or dissolve a granular or liquid wash additive (e.g., fabric softener) before being dispensed to wash tub 121 (e.g., as a wash fluid through exhaust opening 232).

In optional embodiments, a rear portion of shower plate 261 is sealed. For instance, a sealing gasket 316 (e.g., resilient foam or rubber gasket) may extend rearward or upward from a rear segment of shower plate 261 to engage an inner surface of housing 201. During use, the contact between sealing gasket 316 and housing 201 may restrict the rearward flow of water. In turn, water may be forced forward and to water apertures 376.

In certain embodiments, water supply conduit 266 may be fixedly mounted to shower plate 261 and define a water inlet 378 to pod compartment 225. Thus, dispenser drawer 212 may be movable relative to water supply conduit 266. If conduit passage 326 is aligned with water supply conduit 266, water supply conduit 266 may selectively pass through conduit passage 326 (e.g., as dispenser drawer 212 slides from the open position to the closed position). In some such embodiments, in the open position, water supply conduit 266 is held outside of pod compartment 225 or conduit passage 326; in the closed position, water supply conduit 266 is received within pod compartment 225 and conduit passage 326. Advantageously, water supply conduit 266 may be hidden or otherwise held apart from any portion of additive dispenser 200 that a user may contact (e.g., during normal use of washing machine appliance 100—FIG. 2). In other words, a user may be prevented from accidentally contacting or disturbing water supply conduit 266 during normal operations As shown, water supply conduit 266 may include a slanted impingement tip 370 at water inlet 378. Slanted impingement tip 370 may extend downward (e.g., at a constant or variable angle) from a front lip 380 to a rear lip 382. Rear lip 382 may thus be disposed below and rearward from front lip 380. Optionally, water inlet 378 may be defined as multiple inlet slots 384 (e.g., lateral slots). Such inlet slots 384 may be spaced apart from each other (e.g., along the vertical direction V). Additionally or alternatively, inlet slots 384 may be parallel to each other or the lateral direction L. Optionally, one or more slots 384 may be defined rearward from rear lip 382 and directed downward (e.g., along the vertical direction V).

In the closed position, impingement tip 370 extends to or within pod compartment 225 and may abut (e.g., contact) an additive pod (e.g., at front lip 380) within pod compartment 225. Specifically, movement of pod compartment 225 from the open position to the closed position may force an additive pod against front lip 380 without immediately puncturing any portion of the additive pod. Nonetheless, the flow of water through water inlet 378 may cause the abutting portion of the additive pod to eventually puncture or dissolve within pod compartment 225.

Advantageously, slanted impingement tip 370 may contact an additive pod while preventing the additive pod from blocking the water inlet 378. Additionally or alternatively, water from water inlet 378 may be directed at a downward angle, advantageously reducing the transverse force or pressure of water against additive pod, which may otherwise dislocate the additive pod within or from pod compartment 225.

In some embodiments, water supply conduit 266 defines a relief aperture 386 rearward (e.g., at an upstream location) from water inlet 378. As shown, relief aperture 386 may be defined at a top portion of water supply conduit 266. When assembled such that dispenser drawer 212 is fully received within additive dispenser 200, relief aperture 386 may be positioned rearward from (e.g., outside of) pod compartment 225. Moreover, relief aperture 386 may be defined at a portion of water supply conduit 266 that is proximal to primary compartment 222 (e.g., closer to primary compartment 222 than it is secondary compartment 224). In particular, relief aperture 386 may be directed at primary compartment 222. As water flows through water supply conduit 266 (e.g., from valve seat 238), at least a portion of the water may be directed from relief aperture 386 as a pressure-relief water flow. In turn, the pressure-relief water flow may strike the bottom side 392 of shower plate 261 before falling to primary compartment 222. Optionally, one or more ribs 394 may extend (e.g., downward) on the bottom side 392 of shower plate 261 and further help guide the pressure-relief water flow from the relief aperture 386 to the primary compartment 222.

Figure 20:
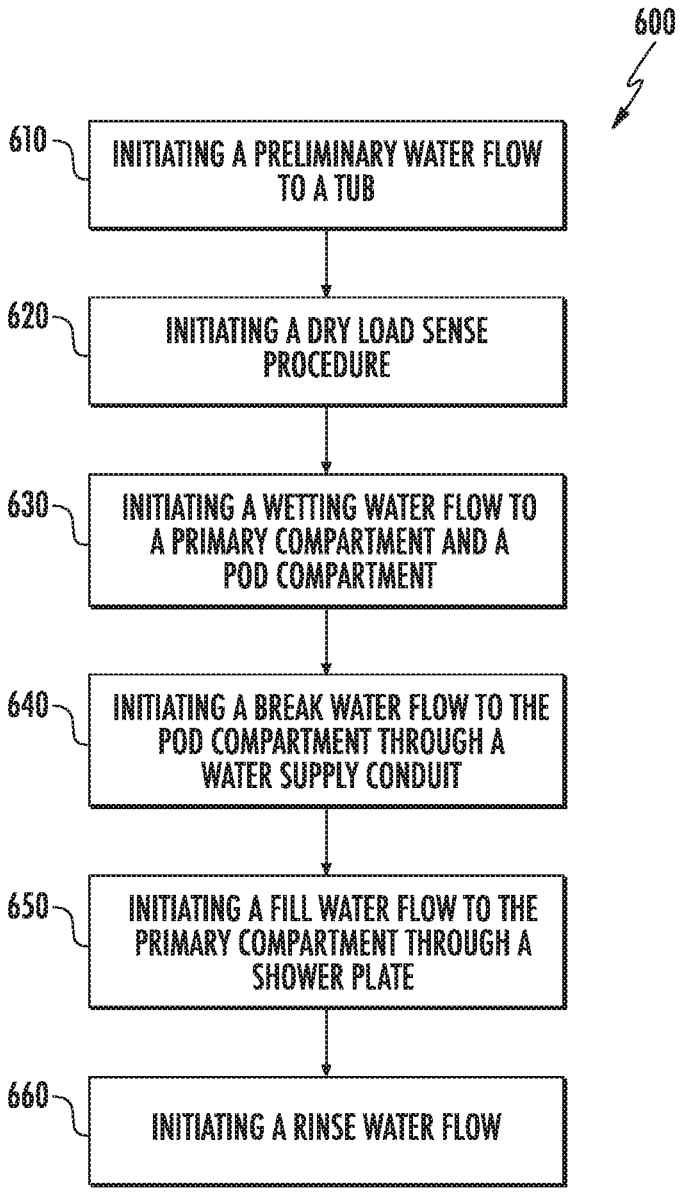
FIG. 20 is a flow chart illustrating a method of operating a washing machine appliance according to exemplary embodiments of the present disclosure.
Figure 21:
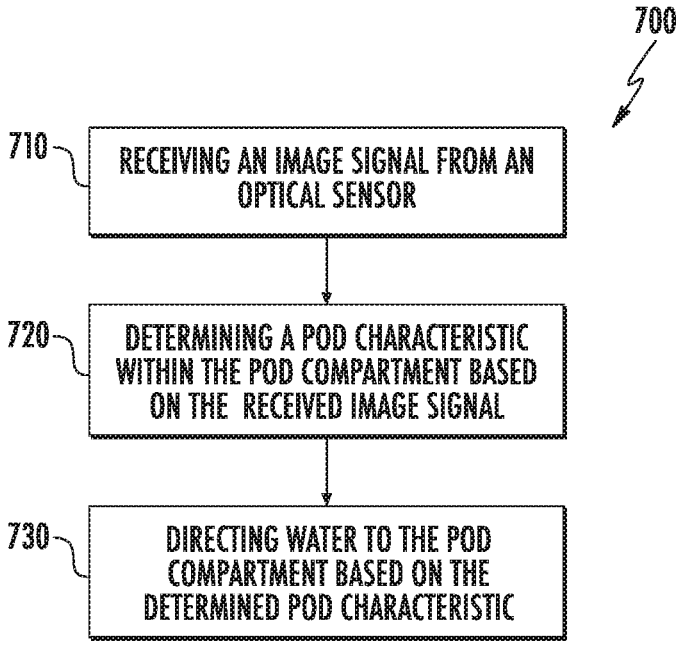
FIG. 21 is a flow chart illustrating a method of operating a washing machine appliance according to exemplary embodiments of the present disclosure.

Referring now to FIGS. 20 and 21, various methods may be provided for use with washing machine appliances in accordance with the present disclosure. In general, the various steps of methods as disclosed herein may, in exemplary embodiments, be performed by the controller 108 (FIG. 1), which may receive inputs and transmit outputs from various other components of the appliance 100 (FIG. 1), such as one or more valves, pressure sensors, or optical sensors. In particular, the present disclosure is further directed to methods, as indicated by reference numbers 600 and 700, for operating a washing machine appliance 100 (e.g., as a washing operation, as described above).

As is understood, and except as otherwise indicated, various steps of the methods 600 and 700 may be omitted or rearranged. Additionally or alternatively, although FIGS. 600 and 700 are illustrated separately, it is understood that various steps may be performed together. For instance, method 700 may be initiated prior to any one of the steps 610 through 630 (e.g., and continue as part of 610 or 630). Additionally or alternatively, method 700 may be initiated following the start of step 630 (e.g., and continue as part of 630 or 640).

Turning especially to FIG. 20, at 610, the method 600 includes initiating a preliminary water flow to the tub. For instance, the preliminary water flow may be directed through the additive dispenser from one or more valves thereon. In some embodiments, the preliminary water flow includes a predetermined volume of water (e.g., relatively low volume of water, such as less than 500 milliliters) dispensed at one or more discrete time intervals, such as prior to any other motion or water flow being initiated at the washing machine appliance during the corresponding washing operation. Optionally, 610 may provide or act as a safety notice within tub. In additional or alternative embodiments, the preliminary water flow may be directed through the water supply conduit, and thereby the pod compartment, prior to flowing to tub. Advantageously, an additive pod within pod compartment may be wetted to initiate dissolution prior to the start of a washing cycle.

At 620, the method 600 includes initiating a dry load sense procedure to determine a size of the load. For instance, as is understood, the controller may receive and interpret one or more signals from a motor or sensor detecting a time and inertia for the basket to coast down to zero (e.g., after reaching a predetermined rotational speed (e.g., in RPM) that is greater than zero to detect the load weight or size prior to any significant volume of water (e.g., greater than 500 milliliters) being added to the tub during the corresponding washing operation. No water may be added to tub during 620. Moreover, 620 may follow (e.g., occur after) the preliminary water flow at 610.

At 630, the method 600 includes initiating a wetting water flow to the primary compartment and the pod compartment. In particular, the wetting water flow may be initiated through the shower plate. Water may thus be directed from the hot water valve or cold water valve through the primary set of apertures, as described above (e.g., for a set amount of time or until a relatively-large predetermined volume, such as more than 500 milliliters, of water is dispensed). In some such embodiments, 630 includes opening both the hot water valve and the cold water valve on additive dispenser upstream from the shower plate (e.g., as dictated by the selected washing operation). As the hot or cold water valve is open, the primary compartment of dispenser drawer may be filled such that water therein flows over the internal pod wall before flowing out from the pod outlet. In certain embodiments, 630 follows (e.g., occurs subsequent to) 610 or 620. Advantageously, an additive pod within the pod compartment may be able to soak and begin dissolving prior to a fill cycle. Additionally or alternatively, a portion of wash additive within primary compartment may be dispensed to tub.

In optional embodiments, 630 includes initiating a wet load sense procedure to determine a type of the load (e.g., cottons, synthetics, etc.) following the wetting water flow. Generally, the goal of the wet load sense procedure is for the washing machine appliance to fill the tub with water or wash fluid until it reaches a specific pressure level from the pressure sensor. More absorbent loads will take a long time to reach the level and less absorbent loads will not take very long to reach the level.

At 640, the method 600 includes initiating a break water flow to the pod compartment through the water supply conduit (e.g., following the wetting water flow at 630). Thus, water may be directed to the pod compartment from the water inlet and to the pod outlet, as described above. In particular, a water valve upstream from the water supply conduit may be opened. In some embodiments, water flow to the primary compartment (e.g., through the valve seats above primary compartment or secondary compartment) may be restricted or otherwise prevented. For instance, 640 may include holding the hot water valve or cold water valve upstream from the primary set of apertures closed to prevent hot or cold water therefrom.

At 650, the method 600 includes initiating a fill water flow to the primary compartment through the shower plate (e.g., following the break water flow at 640), such as part of a fill cycle. Specifically, the hot or cold water valves upstream from the primary set apertures may be opened to direct water to the primary compartment. In some such embodiments, 650 includes opening the hot water valve and the cold water valve upstream from the shower plate. During the fill water flow, the water valve upstream from the water supply conduit may be held closed. Nonetheless, a portion of the water within primary compartment may be flowed over the internal pod wall, as described above, advantageously motivating residue that may remain from an additive pod from pod compartment.

Optionally, the fill water flow may be based on the dry and wet load sense procedures at 620 and 630, respectively. In particular, the controller may determine a target volume of water and may regulate the hot or cold water valves to fill the tub to that target volume or a target temperature, as would be understood.

At 660, the method 600 includes initiating a rinse water flow to the tub (e.g., following the fill water flow at 650). Specifically, the hot or cold water valves upstream from the primary set apertures may be opened to direct water to the primary compartment. In some such embodiments, 660 includes opening the hot water valve and the cold water valve upstream from the shower plate. During the rinse water flow, the water valve upstream from the water supply conduit may be held closed. Nonetheless, a portion of the water within primary compartment may be flowed over the internal pod wall, as described above, advantageously motivating residue that may remain from an additive pod from pod compartment. In some embodiments, 660 follows a drain cycle executed following 650, as would be understood.

The volume of water for the rinse water flow may be set according to a suitable criterion (e.g., a predetermined amount based on the washing operation or, alternatively, the fill water flow).

Turning especially to FIG. 21, at 710, the method 700 includes receiving an image signal from the optical sensor directed at the pod compartment. The image signal may thus include one or more two-dimensional images (e.g., a first two-dimensional image, subsequent second two-dimensional image, etc.), such as within a video feed or as static images (e.g., taken or captured according to a predetermined rate or condition). As would be understood, upon being captured at the optical sensor, the two-dimensional images may be transmitted to the controller (e.g., as the image signal). The two-dimensional images may then be recorded (e.g., temporarily) for analyzation.

Capture of or transmission of the image signal at 710 may be prompted according to a predetermined point of the corresponding washing operation. As an example, capture or transmission may be prompted at the beginning of the washing operation. As an additional or alternative example, capture or transmission may be prompted during or immediately prior to initiating a wetting water flow, a break water flow, fill water flow, or rinse water flow.

At 720, the method 700 includes determining a pod characteristic within the pod compartment based on the received image signal at 710. In particular, 720 may require analyzing the two-dimensional image by edge matching, divide-and-conquer search, greyscale matching, histograms of receptive field responses, or another suitable routine. Thus, object recognition may be performed at 720 such that an additive pod, pod residue, or empty state within pod compartment is identified. In some embodiments, the pod characteristic is a number or size (e.g., volume) of additive pods within pod compartment. In additional or alternative embodiments, the pod characteristic is a type of additive pod (e.g., pod manufacturer, powder-enclosing pod, liquid-enclosing pod, etc.). In further additional or alternative embodiments, the pod characteristic is a residue state (e.g., indicating whether a sub-portion of an additive pod remains within pod compartment).

At 730, the method 700 includes directing water to the pod compartment based on the determined pod characteristic. Thus, the timing, temperature, flow rate, volume, or frequency of water flowing through additive dispenser may be set according to number or size, type, or residue state of an additive pod within pod compartment.

As an example, 730 may include halting water or water flow to the pod compartment. In other words, the water valves upstream from the pod compartment (e.g., upstream from the water supply conduit or primary compartment) may be closed or otherwise restricted such that water is prevented from flowing to the pod compartment. Halting water may be performed in response to an incompatible type of additive pod or an excessive (e.g., over a programmed threshold) number of additive pods being detected within pod compartment. Additionally or alternatively, halting water may be performed if no additive pods are (e.g., an empty characteristic or state is) detected within the pod compartment.

As an additional or alternative example, 730 may include adjusting (e.g., setting, increasing, or decreasing) a temperature of water to the pod compartment based on the determined pod characteristic. In particular, some types additive pods may require water to be at a certain temperature in order to adequately dissolved. If such a type of additive pod is detected (e.g., at 720), the temperature of water to the pod compartment may be adjusted to reach that certain temperature. Additionally or alternatively, the temperature of water to the pod compartment may be incrementally increased, for instance, in response to a certain amount or volume (e.g., predetermined threshold amount or volume) of pod residue being detected in the pod compartment at 720, such as in a partially-dissolved pod state.

In order to adjust the temperature, the hot water valve may be selectively opened or closed according to the adjusted temperature. In some such embodiments, hot water is permitted to flow to the pod compartment through the primary compartment, as described above.

As another additional or alternative example, 730 may include initiating an additional water flow. The additional water flow may be an incremental time or volume of water to be directed to the pod compartment (e.g., beyond a default amount of a certain operation or cycle). Thus, one or more water valves upstream from the pod compartment (e.g., upstream from the water supply conduit or primary compartment) may be opened for a programmed increment of time or until an incremental volume of water is dispensed. The additional water flow may be initiated, for instance, in response to a certain amount or volume (e.g., predetermined threshold amount or volume) of pod residue detected in the pod compartment at 720, such as in a partially-dissolved pod state.

As yet another additional or alternative example, 730 may include increasing a water flow rate to the pod compartment. For instance, the flow rate of water through the water supply conduit upstream from the pod compartment may be increased from an initial flow rate. Specifically, the water valve upstream from the water supply conduit may be opened further such that the flow rate of water to and through the water supply conduit is increased. The increase may be incremental or a predetermined flow rate based on the detected condition.

Optionally, the flow rate may correspond to a detected number of multiple additive pods (i.e., the number of additive pods detected within the pod compartment at 720). Additionally or alternatively, the flow rate of water to the pod compartment may be increased, for instance, in response to a certain amount or volume (e.g., predetermined threshold amount or volume) of pod residue detected in the pod compartment at 720, such as in a partially-dissolved pod state. Also additionally or alternatively, the flow rate of water to the pod compartment may be increased in response to a certain type of additive pod being detected at 720.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:
- a cabinet defining an opening;
- a tub disposed within the cabinet;
- a basket rotatably mounted within the tub to rotate about a rotation axis; and
- a fluid additive dispenser comprising
- a housing extending between an open front end and a closed rear end, the housing being disposed within the cabinet, and
- a dispenser drawer selectively received in the housing above the basket, the dispenser drawer extending from a forward end proximate to the rotation axis to a rearward end distal to the rotation axis, the dispenser drawer defining a primary compartment and a pod compartment adjacent to the primary compartment between the forward end and the rearward end, the dispenser drawer further defining a pod outlet extending through a wall of the pod compartment to direct a wash fluid therefrom,
- wherein the pod outlet is defined as a curved arc with a tip of the curved arc disposed proximal to the forward end.

2. The washing machine appliance of claim 1, wherein the dispenser drawer further defines a conduit passage,
- wherein the pod outlet extends vertically through a wall of the pod compartment to direct a wash fluid therefrom, the conduit passage extending horizontally through an internal pod wall upstream from the pod outlet, and
- wherein the dispenser drawer comprises an internal pod wall defining the pod compartment, the internal pod wall having a tall wall segment and a short wall segment, the tall wall segment extending circumferentially about a first portion of the pod compartment, the short wall segment extending circumferentially about a second portion of the pod compartment, the short wall segment being disposed between the primary compartment and the pod compartment.

3. The washing machine appliance of claim 2, wherein the primary compartment is partially defined by a bottom wall, and wherein a cup siphon extends upward from the bottom wall, the cup siphon defining a primary outlet through the bottom wall of the primary compartment.

4. The washing machine appliance of claim 2, wherein the fluid additive dispenser further comprises a shower plate mounted within the housing upstream from the primary compartment.

5. The washing machine appliance of claim 1, wherein the pod compartment is partially defined by a bottom wall sloped downward toward the pod outlet.

6. The washing machine appliance of claim 4, wherein the shower plate is sealed at the rearward end to force wash fluid toward the forward end.

7. The washing machine appliance of claim 1, wherein the pod outlet is disposed directly above the basket.

8. The washing machine appliance of claim 1, wherein the pod compartment further defines a drain hole horizontally spaced apart from the pod outlet and forward therefrom.

9. The washing machine appliance of claim 1, wherein the dispenser drawer further comprises
- a secondary compartment adjacent to the pod compartment between the forward end and the rearward end, and
- a secondary outlet extending from the secondary compartment to direct a secondary wash fluid to the basket.

10. A washing machine appliance, comprising:
- a cabinet defining an opening;
- a tub disposed within the cabinet;
- a basket rotatably mounted within the tub to rotate about a rotation axis; and
- a fluid additive dispenser comprising
- a housing extending between an open front end and a closed rear end, the housing being disposed within the cabinet, and
- a dispenser drawer slidably received in the housing above the basket, the dispenser drawer extending from a forward end proximate to the rotation axis to a rearward end distal to the rotation axis, the dispenser drawer defining a primary compartment and a pod compartment adjacent to the primary compartment between the forward end and the rearward end, the dispenser drawer further defining a pod outlet extending through a wall of the pod compartment, the dispenser drawer further defining a conduit passage, the dispenser drawer comprising an internal pod wall defining the pod compartment, the internal pod wall having a tall wall segment and a short wall segment, the tall wall segment extending circumferentially about a first portion of the pod compartment, the short wall segment extending circumferentially about a second portion of the pod compartment, the short wall segment being disposed between the primary compartment and the pod compartment, the pod outlet extending vertically through a wall of the pod compartment to direct a wash fluid therefrom, the conduit passage extending horizontally through an internal pod wall upstream from the pod outlet.

11. The washing machine appliance of claim 10, wherein the pod outlet is defined as a curved arc.

12. The washing machine appliance of claim 10, wherein the primary compartment is partially defined by a bottom wall, and wherein a cup siphon extends upward from the bottom wall, the cup siphon defining a primary outlet opening through the bottom wall of the primary compartment.

13. The washing machine appliance of claim 10, wherein the fluid additive dispenser further comprises a shower plate disposed within the housing upstream from the primary compartment.

14. The washing machine appliance of claim 10, wherein the pod compartment is partially defined by a bottom wall sloped downward toward the pod outlet.

15. The washing machine appliance of claim 10, wherein the shower plate is sealed at the rearward end to force wash fluid toward the front end.

16. The washing machine appliance of claim 10, wherein the pod outlet is disposed directly above the basket.

17. The washing machine appliance of claim 10, wherein the bottom wall of the pod compartment further defines a drain hole horizontally spaced apart from the pod outlet and forward therefrom.

18. The washing machine appliance of claim 10, wherein the dispenser drawer further comprises a secondary compartment adjacent to the pod compartment between the forward end and the rearward end, the tall wall segment being disposed between the secondary compartment and the pod compartment, and a secondary outlet extending from the secondary compartment to direct a secondary wash fluid to the basket.

19. A washing machine appliance, comprising:

a cabinet defining an opening;

a tub disposed within the cabinet;

a basket rotatably mounted within the tub to rotate about a rotation axis; and a fluid additive dispenser comprising a housing extending between an open front end and a closed rear end, the housing being disposed within the cabinet, and a dispenser drawer slidably received in the housing above the basket, the dispenser drawer extending from a forward end proximate to the rotation axis to a rearward end distal to the rotation axis, the dispenser drawer defining a primary compartment and a pod compartment adjacent to the primary compartment between the forward end and the rearward end, the dispenser drawer further defining a pod outlet extending through a wall of the pod compartment, the dispenser drawer further defining a conduit passage, the dispenser drawer comprising an internal pod wall defining the pod compartment, the internal pod wall having a tall wall segment and a short wall segment, the tall wall segment extending circumferentially about a first portion of the pod compartment, the short wall segment extending circumferentially about a second portion of the pod compartment, the short wall segment being disposed between the primary compartment and the pod compartment, the pod outlet extending vertically through a wall of the pod compartment to direct a wash fluid therefrom, the conduit passage extending horizontally through an internal pod wall upstream from the pod outlet, wherein the pod outlet is defined as a curved arc with a tip of the curved arc disposed proximal to the forward end.

* * * * *